US007347524B2

(12) United States Patent
Yoshida

(10) Patent No.: US 7,347,524 B2
(45) Date of Patent: Mar. 25, 2008

(54) PRINTING METHOD AND PRINTING APPARATUS

(75) Inventor: Masahiko Yoshida, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 213 days.

(21) Appl. No.: 11/050,648

(22) Filed: Feb. 4, 2005

(65) Prior Publication Data

US 2005/0206668 A1 Sep. 22, 2005

(30) Foreign Application Priority Data

Feb. 4, 2004 (JP) ..... 2004-028129

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS 6,354,688 B1 * 3/2002 Inoue et al. ..... 347/15
6,390,598 B2 * 5/2002 Sato et al. ..... 347/41

FOREIGN PATENT DOCUMENTS

JP 02-054676 A 2/1990

* cited by examiner

*Primary Examiner*—Julian D. Huffman
(74) *Attorney, Agent, or Firm*—Sughrue Mion, PLLC

(57) ABSTRACT

A printing method and printing apparatus by which the quality of printed images can be improved are achieved. The printing method includes: (a) a step of printing a correction pattern on a medium, wherein the correction pattern is constituted by a line group including a plurality of lines arranged in an intersecting direction that intersects a movement direction of nozzles, each of the lines being made of a plurality of dots arranged in the movement direction, and is printed by alternately repeating an operation of ejecting ink from a plurality of the nozzles and an operation of moving the medium in the intersecting direction; (b) a step of setting for each of the lines a correction value for correcting a darkness in the intersecting direction of an image to be printed on the medium, wherein each of the correction values is set based on a darkness of a plurality of lines, in the line group, including the line whose correction value is to be set; and (c) a step of printing the image on the medium based on the correction values that have been set for each of the lines.

11 Claims, 27 Drawing Sheets

TM

| | | | |
|---|---|---|---|
| 1 | 9 | 3 | 11 |
| 13 | 5 | 15 | 7 |
| 4 | 12 | 2 | 10 |
| 16 | 8 | 14 | 6 |

UM

| | | | |
|---|---|---|---|
| 16 | 8 | 14 | 6 |
| 4 | 12 | 2 | 10 |
| 13 | 5 | 15 | 7 |
| 1 | 9 | 3 | 11 |

PRINTING METHOD AND PRINTING APPARATUS

CROSS-REFERENCE TO RELATED APPLICATIONS

The present application claims priority upon Japanese Patent Application No. 2004-028129 filed on Feb. 4, 2004, which is herein incorporated by reference.

BACKGROUND OF THE INVENTION

1. Field of the Invention

The present invention relates to printing methods and printing apparatuses.

2. Description of the Related Art

Inkjet printers (hereinafter simply referred to as "printers") that eject ink onto paper serving as a medium to form dots are known as printing apparatuses for printing images. These printers repeat in alternation a dot formation operation of forming dots on a paper by ejecting ink from a plurality of nozzles, which move together with a carriage, and a carrying operation of carrying the paper in an intersecting direction that intersects the movement direction (hereinafter, referred to as the "carrying direction") using a carry unit. By repeating these operations, raster lines are formed on the paper that consist of a plurality of dots arranged in the movement direction of the carriage. An image is printed by a plurality of the raster lines being formed in the carrying direction.

With this type of printer, the ink-droplet ejection characteristics, such as the amount of the ink droplet and the travel direction, vary from nozzle to nozzle. Such variations in the ejection characteristics are a cause of darkness non-uniformities in printed images, and thus are not preferable. Accordingly, with conventional methods, a correction value is set for each nozzle and the amount of ink is adjusted based on those correction values that are set (see JP 2-54676A for example).

In this conventional method, an output-characteristics coefficient that indicates the characteristics of the ink ejection amount for each nozzle is stored in a head-characteristics register. Then, when an ink droplet is to be ejected, this output-characteristics coefficient is used to prevent darkness non-uniformities in the printed image.

However, the above-mentioned conventional method corrects the ejection amount of each nozzle but does not give consideration to darkness non-uniformities caused by the travel curve of ink droplets. Such darkness non-uniformities are related to the landing position of ink droplets ejected from the nozzles and are brought about by displacement in the carrying direction from the normal position. That is, the spacing between adjacent raster lines becomes narrower or wider than the defined spacing. Accordingly, such darkness non-uniformities are caused due to the combination of nozzles that form each raster line. And for this reason, with conventional methods, darkness non-uniformities due to the travel curve of ink droplets may arise when the sequence of the nozzles that form each raster line is different from the arrangement of nozzles in the heads.

For example, darkness non-uniformities may occur when using the interlaced mode as the print mode. The interlaced mode is a print mode in which an unformed raster line is set between raster lines that are formed in a single dot formation operation and all of the raster lines are formed in a complementary manner through a plurality of dot formation operations. With this print mode, adjacent raster lines are not printed by the same nozzle. With this interlaced mode, there are cases in which the sequence of the nozzles responsible for adjacent raster lines in the printed image differs from the arrangement of nozzles in the heads, and darkness non-uniformities due to the travel curve may occur in these cases. These occurrences of darkness non-uniformities reduce the quality of printed images.

SUMMARY OF THE INVENTION

The present invention was arrived at in light of the foregoing issues, and it is an object thereof to achieve a printing method and a printing apparatus that are capable of improving the quality of printed images.

A main aspect for achieving the above object is a printing method comprising:

(a) a step of printing a correction pattern on a medium, wherein the correction pattern:

is constituted by a line group including a plurality of lines arranged in an intersecting direction that intersects a movement direction of nozzles, each of the lines being made of a plurality of dots arranged in the movement direction, and is printed by alternately repeating an operation of ejecting ink from a plurality of the nozzles and an operation of moving the medium in the intersecting direction;

(b) a step of setting for each of the lines a correction value for correcting a darkness in the intersecting direction of an image to be printed on the medium, wherein each of the correction values is set based on a darkness of a plurality of lines, in the line group, including the line whose correction value is to be set; and (c) a step of printing the image on the medium based on the correction values that have been set for each of the lines.

Features and objects of the present invention other than the above will be made clear by reading the present specification with reference to the accompanying drawings.

BRIEF DESCRIPTION OF THE DRAWINGS

For a more complete understanding of the present invention and the advantages thereof, reference is now made to the following description taken in conjunction with the accompanying drawings.

DESCRIPTION OF PREFERRED EMBODIMENTS

Figure 1:
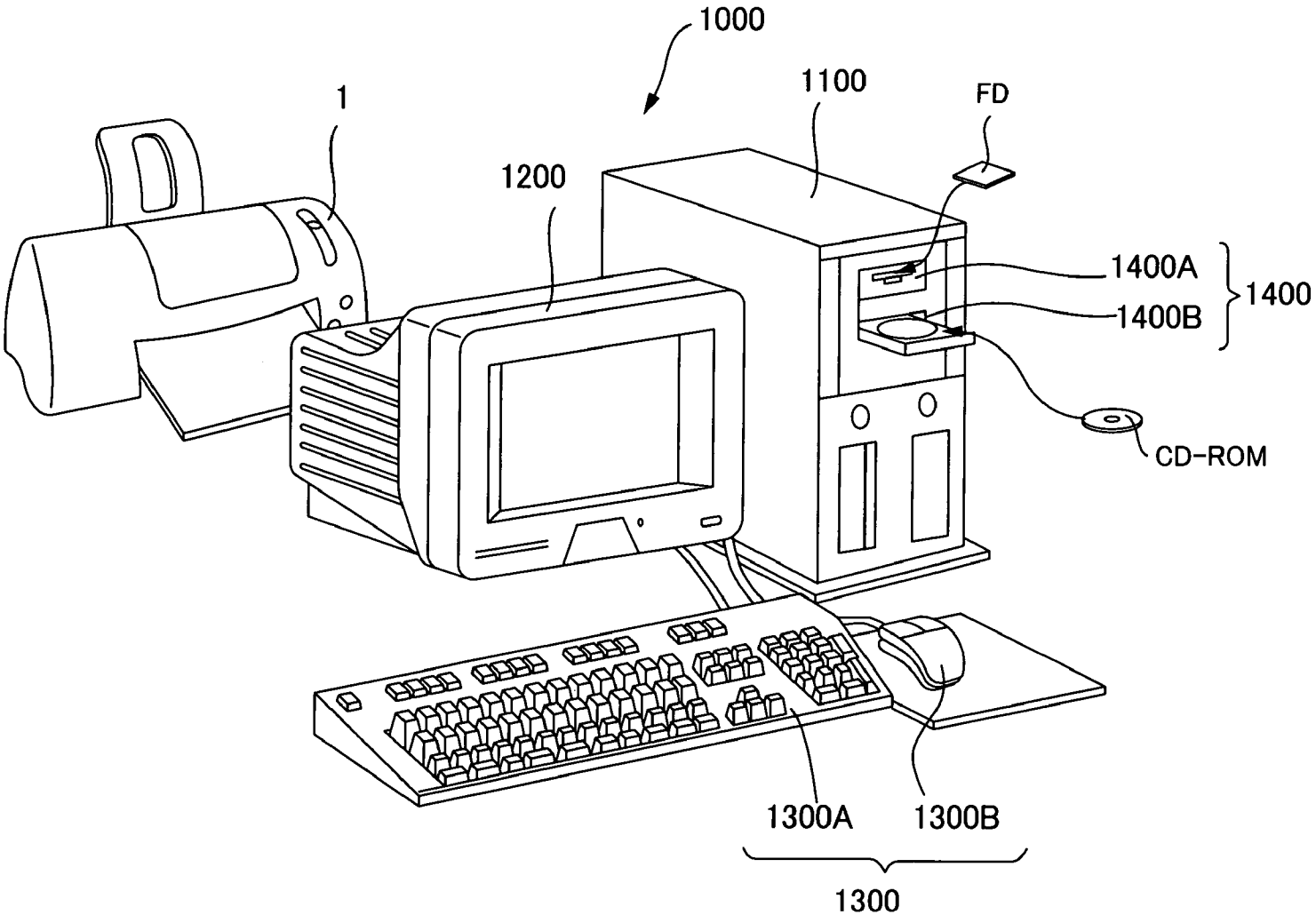
FIG. 1 is an explanatory diagram of the overall configuration of a printing system.

At least the following matters will be made clear by the present specification and the accompanying drawings.

It is possible to achieve a printing method comprising:

(a) a step of printing a correction pattern on a medium, wherein the correction pattern:

is constituted by a line group including a plurality of lines arranged in an intersecting direction that intersects a movement direction of nozzles, each of the lines being made of a plurality of dots arranged in the movement direction, and is printed by alternately repeating an operation of ejecting ink from a plurality of the nozzles and an operation of moving the medium in the intersecting direction;

(b) a step of setting for each of the lines a correction value for correcting a darkness in the intersecting direction of an image to be printed on the medium, wherein each of the correction values is set based on a darkness of a plurality of lines, in the line group, including the line whose correction value is to be set; and (c) a step of printing the image on the medium based on the correction values that have been set for each of the lines.

With such a printing method, the darkness of each line is corrected using a correction value for each line, and therefore it is possible to form each line at the desired darkness even if the order of nozzles responsible for the lines that are adjacent in the carrying direction of the print image is different from the arrangement of nozzles in the head. Furthermore, when setting the correction value for a particular line, the darkness of other lines in the correction pattern is taken into account, and therefore darkness is smoothed out by the amount this is taken into account. For this reason, it is possible to prevent an abrupt change between adjacent lines as regards the correction values that are set. As a result, it is possible to prevent the darkness of a given line from being excessively corrected. Accordingly, this allows darkness non-uniformities to be inhibited, as well as prevents graininess from being adversely affected, and improves the quality of printed images.

In this printing method, it is preferable that each of the correction values is set based on a darkness of N lines that are adjacent to one another in the intersecting direction. With such a printing method, each correction value is set based on the darkness of N lines that are adjacent in the intersecting direction, and therefore the darkness of other lines extremely close to a particular line for which a correction value is to be set can be taken into account. In this way, it is possible to set appropriate correction values and the quality of printed images can be further improved.

In this printing method, it is preferable that the N lines are two to four lines. With such a printing method, the correction values are set based on the darkness of from two to four lines, and therefore the darkness of these lines can be sufficiently reflected when setting the correction value of a particular line. In this way, it is possible to set a correction value that suits that line and the quality of printed images can be further improved.

In this printing method, it is preferable that the correction value is set to a value that is shared by the N lines. With such a printing method, a common correction value is set for the N lines, and therefore the amount of correction value data can be reduced.

In this printing method, it is preferable that the shared value is an average value of provisional correction values, each of the provisional correction values being obtained based on the darkness of the respective one of the N lines. With such a printing method, the average value of provisional correction values of the respective N lines is used as a shared value, and therefore it is possible set an appropriate correction value for each of the lines. As a result, the quality of the printed image can be further improved.

In this printing method, it is preferable that the correction value of a given line is set based on the darkness of each of the N lines. With such a printing method, a correction value is set for each given line, and therefore it is possible to set a correction value that suits that line even more and the quality of printed images can be further improved.

In this printing method, it is preferable that the correction value of the given line is an average value of provisional correction values, each of the provisional correction values being obtained based on the darkness of the respective one of the N lines. With such a printing method, the average value of provisional correction values of the respective N lines is set as the correction value of the given line, and therefore it is possible set appropriate correction values for the given lines. As a result, the quality of the printed image can be further improved.

In this printing method, it is preferable that the average value of the provisional correction values is an average value of a provisional correction value corresponding to the given line and provisional correction values corresponding to lines that are adjacent to the given line on both sides thereof in the intersecting direction and that sandwich the given line. With such a printing method, the correction value of the given line is set taking into account the provisional correction values of the lines adjacent on both sides in the intersecting direction, and therefore it is possible to set appropriate correction values for the given lines. As a result, the quality of the printed image can be further improved.

In this printing method, it is preferable that the average value of the provisional correction values is an average value of a provisional correction value corresponding to the given line and a provisional correction value corresponding to a line that is adjacent to the given line on one side thereof in the intersecting direction. With such a printing method, the correction value of the given line is set taking into account the provisional correction value of the line adjacent on one side in the intersecting direction, and therefore it is possible set appropriate correction values for the given lines. As a result, the quality of the printed image can be further improved.

In this printing method, it is preferable that, in the step of printing the image on the medium based on the correction values that have been set for each of the lines, the lines are formed at a darkness corresponding to gradation values, and the gradation values of the image are changed based on the correction values. With such a printing method, the gradation values that indicate darkness are changed using the correction values, and therefore processing can be simplified to enable high-frequency ejection of ink.

In this printing method, it is preferable that, in the step of printing the image on the medium based on the correction values that have been set for each of the lines, a line that is not formed is set between the lines that are formed by carrying out the operation of ejecting ink from the plurality of the nozzles once, and lines are formed in a complementary manner by carrying out the operation of ejecting ink from the plurality of the nozzles a plurality of times. With such a printing method, the relationship of nozzles responsible for adjacent lines may not match the arrangement (order of alignment) of the nozzles that constitute a nozzle row, but even in this case, darkness non-uniformities in images can be effectively suppressed.

It is also possible to achieve a printing apparatus such as the following.

That is, a printing apparatus comprises:

nozzles for ejecting ink;

a carry unit for carrying a medium in an intersecting direction that intersects the movement direction; and a controller for controlling ejection of ink from the nozzles and carrying of the medium by the carry unit, the controller:

(A) printing a correction pattern on the medium using the nozzles and the carry unit, wherein the correction pattern:

is constituted by a line group including a plurality of lines arranged in the intersecting direction that intersects the movement direction, each of the lines being made of a plurality of dots arranged in the movement direction of the nozzles, and is printed by alternately repeating an operation of ejecting ink from a plurality of the nozzles and an operation of moving the medium in the intersecting direction;

(B) setting for each of the lines a correction value for correcting a darkness in the intersecting direction of an image to be printed on the medium, wherein each of the correction values is set based on a darkness of a plurality of lines, in the line group, including the line whose correction value is to be set; and (C) printing, using the nozzles and the carry unit, the image on the medium based on the correction values that have been set for each of the lines.

With such a printing apparatus, it is possible to suppress darkness non-uniformities while also preventing graininess from being adversely affected, and to improve the quality of printed images.

First Embodiment

Configuration of the Printing System

An embodiment of a printing system is described next with reference to the drawings.

FIG. 1 is an explanatory diagram showing the external structure of a printing system 1000. The printing system 1000 is provided with a printer 1, a computer 1100, a display device 1200, input devices 1300, and record/play devices 1400. The printer 1 is a printing apparatus for printing images on a medium such as paper, cloth, or film. It should be noted that the following description is made using paper S (see FIG. 9), which is a representative medium, as an example. The computer 1100 is communicably connected to the printer 1, and outputs to the printer 1 print data corresponding to an image to make the printer 1 print the image. The display device 1200 has a display, and displays a user interface of, for example, an application program 1104 or a printer driver 1110 (see FIG. 2). The input devices 1300 are constituted by a keyboard 1300A and a mouse 1300B for example. The input devices 1300 are used when operating the application program 1104 and performing the settings for the printer driver 1110 in accordance with the user interface displayed on the display device 1200. A flexible disk drive device 1400A and a CD-ROM drive device 1400B are employed as the record/play devices 1400.

The printer driver 1110 is installed on the computer 1100. The printer driver 1110 is a computer program for achieving functions of displaying the user interface on the display device 1200. In addition to this, the printer driver 1110 is also a computer program for achieving the function of converting image data that is output from the application program 1104 into print data. The printer driver 1110 is recorded on a storage medium (computer-readable storage medium) such as a flexible disk FD or a compact disk CD-ROM. Furthermore, the printer driver 1110 can also be downloaded onto the computer 1100 via the Internet. The printer driver 1110 is made of codes for achieving various functions.

It should be noted that "printing apparatus" in a narrow sense means the printer 1, but in a broader sense it means the system constituted by the printer 1 and the computer 1100.

===Printer Driver===

Regarding the Printer Driver

Figure 2:
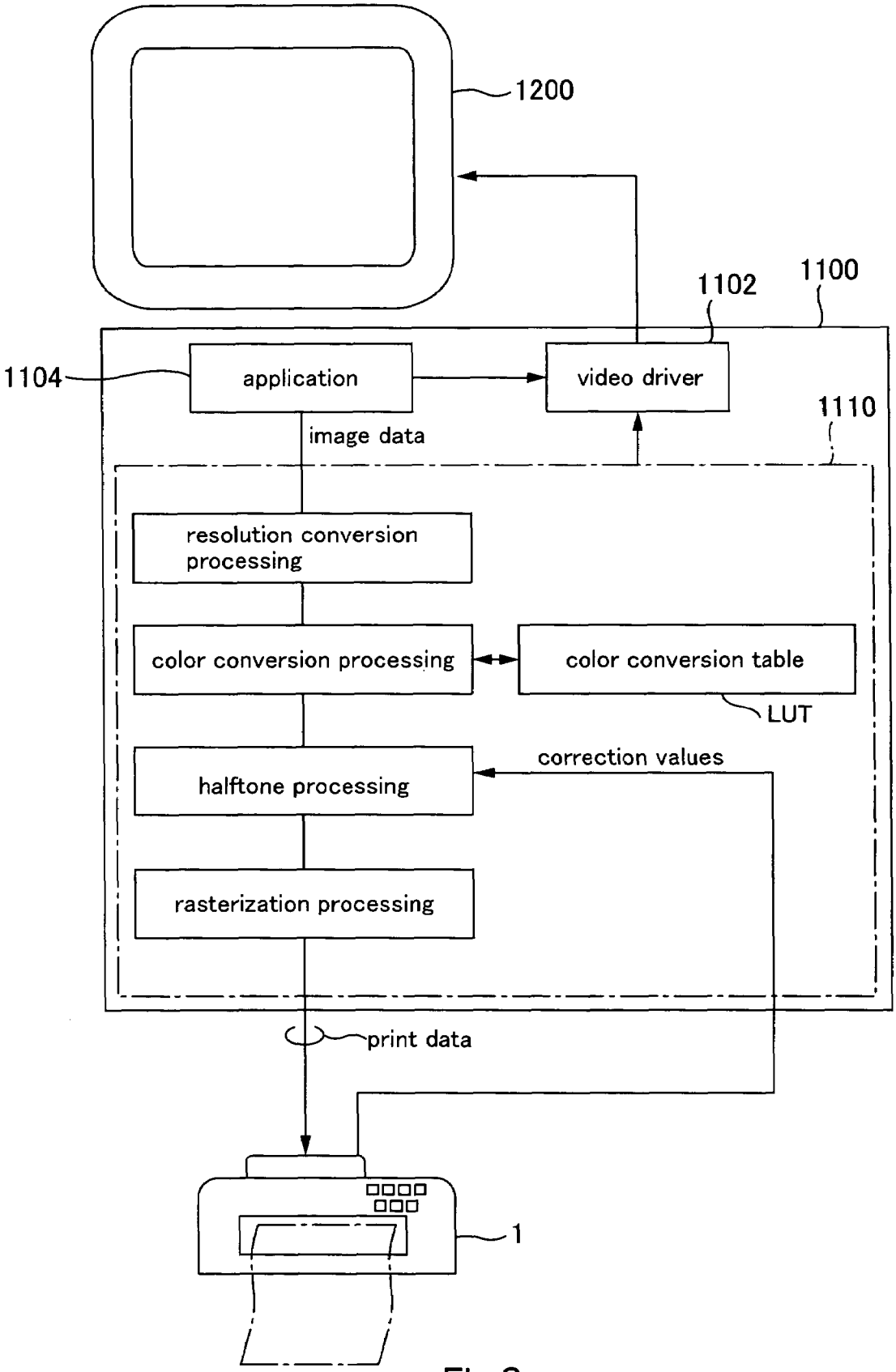
FIG. 2 is an explanatory diagram of processes carried out by a printer driver.

FIG. 2 is a schematic explanatory diagram of the basic processes carried out by the printer driver 1110. It should be noted that structural elements that have already been described are assigned identical reference numerals and thus further description thereof is omitted.

On the computer 1100, computer programs such as a video driver 1102, the application program 1104, and the printer driver 1110 operate under an operating system installed on the computer 1100. The video driver 1102 has a function of displaying, for example, the user interface on the display device 1200 in accordance with display commands from the application program 1104 and the printer driver 1110. The application program 1104 has such functions as enabling image editing and generates data relating to an image (image data). A user can give an instruction to print an image edited by the application program 1104 via the user interface of the application program 1104. Upon receiving the print instruction, the application program 1104 outputs the image data to the printer driver 1110.

The printer driver 1110 receives the image data from the application program 1104, converts the image data into print data, and outputs the print data to the printer 1. The image data has pixel data as data relating to the pixels of the image to be printed. Values such as the gradation values of the pixel data are then converted in accordance with later-described processing stages, and are ultimately converted, at the print data stage, into data relating to the dots to be formed on the paper (data such as the color and the size of the dots). Here, print data is data in a format that can be interpreted by the printer 1 and includes the pixel data described above and various command data. Furthermore, "command data" refers to data for instructing the printer 1 to carry out a specific operation, and is data indicating the carry amount, for example.

It should be noted that the "pixels" are virtually-set square boxes on the paper in order to define the positions onto which ink lands to form dots. In other words, the pixels are regions on the medium on which dots can be formed, and can be thought of as "dot formation units."

In order to convert the image data that is output from the application program 1104 into print data, the printer driver 1110 carries out such processes as resolution conversion processing, color conversion processing, halftone processing, and rasterization processing. The various processes carried out by the printer driver 1110 are described below.

Resolution conversion is a process for converting image data (text data, image data, etc.) output from the application program 1104 to the resolution (the spacing between dots when printing; also referred to as "print resolution") for printing the image on the paper S. For example, when the print resolution has been specified as 720×720 dpi, then the image data obtained from the application program 1104 is converted into image data having a resolution of 720×720 dpi. Pixel data interpolation and decimation are examples of this conversion method. For example, if the resolution of the image data is lower than the print resolution that has been designated, then linear interpolation or the like is performed to create new pixel data between adjacent pixel data. Conversely, if the resolution of the image data is higher than the print resolution that has been designated, then the pixel data is decimated, for example, at a set ratio to adjust the resolution of the image data to the print resolution. Also, in this resolution conversion processing, the size of the print region (which is the region onto which ink is actually ejected) is adjusted based on the image data.

It should be noted that the pixel data in the image data has gradation values of many levels (for example, 256 levels) expressed in RGB color space. The pixel data having such RGB gradation values is hereinafter referred to as "RGB pixel data," and the image data made of these RGB pixel data is referred to as "RGB image data."

Color conversion is a process for converting the RGB pixel data of the RGB image data into data having gradation values of many levels (for example, 256 levels) expressed in CMYK color space. C, M, Y, and K are the ink colors of the printer 1. That is, C stands for cyan, M stands for magenta, Y stands for yellow, and K stands for black. Hereinafter, the pixel data having CMYK gradation values are referred to as "CMYK pixel data", and the image data made of these CMYK pixel data are referred to as "CMYK image data". Color conversion processing is carried out by the printer driver 1110 referencing a color conversion table LUT (also referred to as "color conversion lookup table") that correlates RGB gradation values and CMYK gradation values.

Halftoning is a process for converting CMYK pixel data having many gradation values into CMYK pixel data having few gradation values, which can be expressed by the printer 1. For example, through halftoning, CMYK pixel data representing 256 gradation values is converted into 2-bit CMYK pixel data representing four gradation values. The 2-bit CMYK pixel data is data that indicates, for each color, "no dot formation" (binary value "00"), "small dot formation" (binary value "01"), "medium dot formation" (binary value "10"), and "large dot formation" (binary value "11"), for example.

Dithering or the like is used for such halftoning to create 2-bit CMYK pixel data with which the printer 1 can form dots in a dispersed manner. Half toning through dithering is described later. Also, the method used for halftoning is not limited to dithering, and it is also possible to use gamma correction or error diffusion. Also, in the halftoning in this embodiment, darkness correction based on a correction value is performed. Darkness correction will be described in detail later.

Rasterization is a process for changing CMYK image data that has been subjected to halftoning into the data order in which it is to be transferred to the printer 1. Data that has been rasterized is output to the printer 1 as print data.

Halftoning Through Dithering

Figure 3:
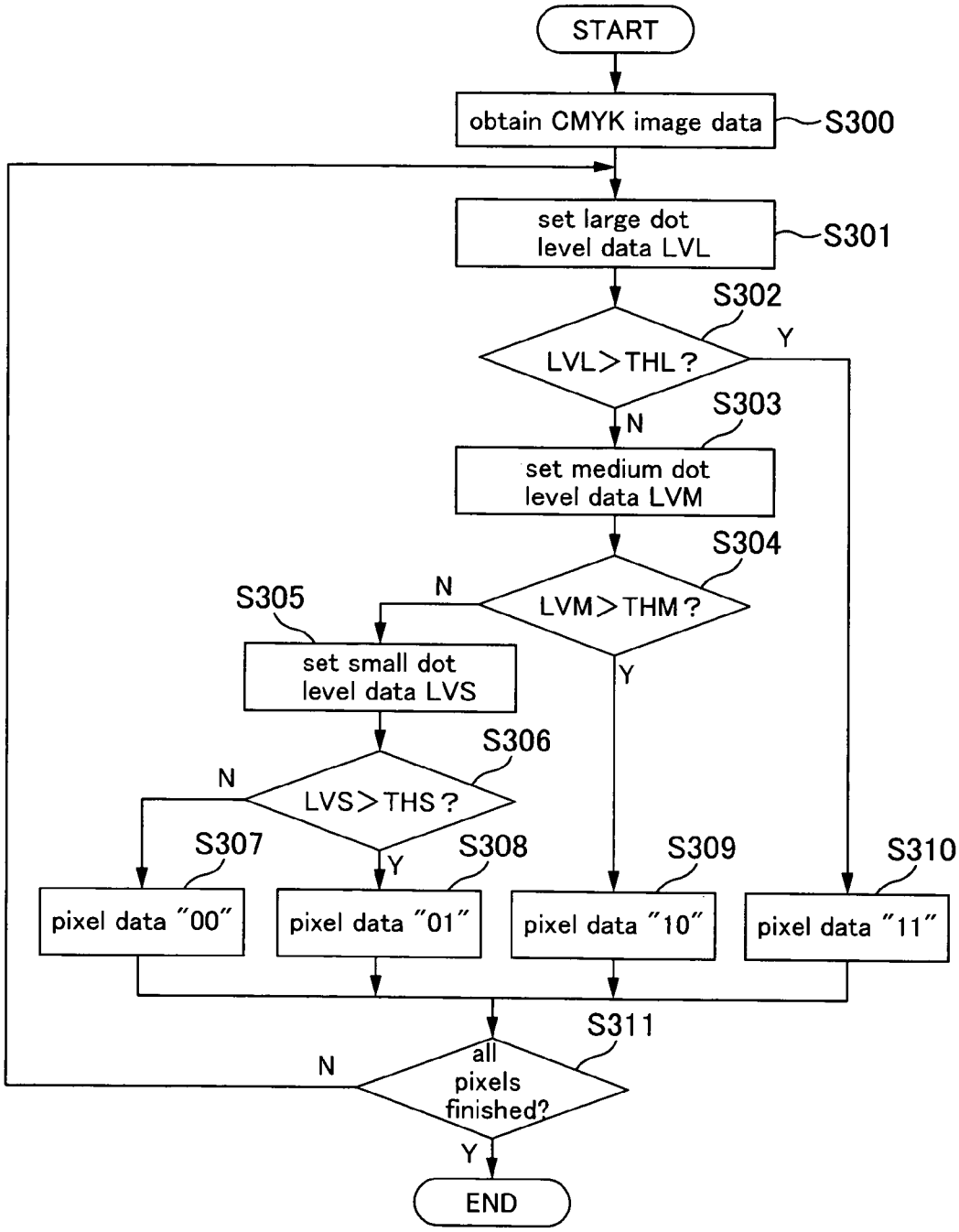
FIG. 3 is a flowchart of halftone processing through dithering.

Here, halftoning through dithering is described in more detail. FIG. 3 is a flowchart of halftoning through dithering. The printer driver 1110 performs the following steps in accordance with this flowchart.

First, in Step S300, the printer driver 1110 obtains the CMYK image data. The CMYK image data is made of image data expressed by 256 gradation values for each ink color C, M, Y, and K for example. In other words, the CMYK image data includes C image data for cyan (C), M image data for magenta (M), Y image data for yellow (Y), and K image data for black (K). The C, M, Y, and K image data are respectively made of C, M, Y, and K pixel data indicating the gradation values of that ink color. It should be noted that the following description can be applied to any of the C, M, Y, and K image data, and thus the K image data is described as representative image data.

The printer driver 1110 performs the processing of the Steps S301 to S311 for all of the K pixel data of the K image data while successively changing the K pixel data to be processed. Through this processing, the K image data is converted into 2-bit data having gradation values of the four levels mentioned above for each K pixel data.

Figure 4:
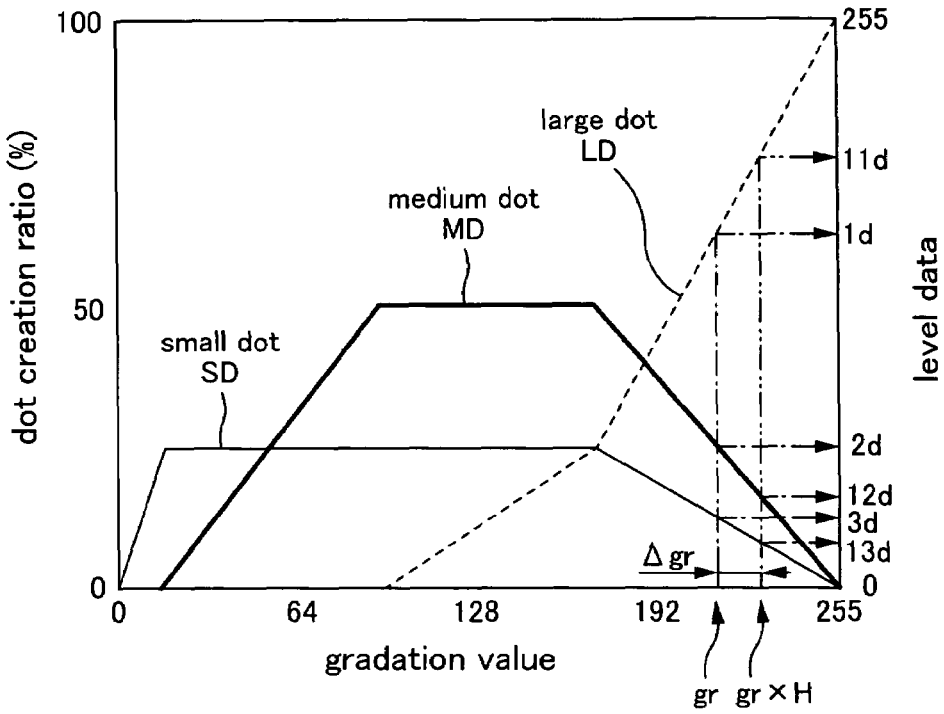
FIG. 4 is a diagram showing a dot creation ratio table.

This conversion process is described in greater detail below. First, in Step S301, the large dot level LVL is set in accordance with the gradation value of the K pixel data to be processed. A dot creation ratio table for example is used to make this setting. FIG. 4 is a diagram showing a dot creation ratio table that is used for setting the level data for each of the large, medium, and small dots. In this diagram, the horizontal axis indicates gradation values (0-255), the vertical axis on the left is the dot creation ratio (%), and the vertical axis on right is the level data. Here, "level data" refers to data whose dot creation ratio has been converted to one of 256 gradation values from 0 to 255. Further, "dot creation ratio" is used to mean the ratio of pixels, among a plurality of pixels within a certain region, for which dots are formed when that region is to be reproduced according to a predetermined gradation value. For example, take a case in which the dot creation ratio for a particular gradation value is large dot 65%, medium dot 25%, and small dot 10%, and at this dot creation ratio, a region of 100 pixels made of 10 pixels in the vertical direction by 10 pixels in the horizontal direction is printed. In this case, of the 100 pixels, 65 of the pixels will be formed by large dots, 25 of the pixels will be formed by medium dots, and 10 of the pixels will be formed by small dots. The profile SD shown by the thin solid line in FIG. 4 indicates the dot creation ratio of the small dots. Also, the profile MD shown by the thick solid line indicates the dot creation ratio of the medium dots, and the profile LD shown by the dotted line indicates the creation ratio of the large dots.

Consequently, in Step S301, the level data LVL corresponding to the gradation values is read from the profile LD for large dots. For example, as shown in FIG. 4, if the gradation value of the K pixel data to be processed is gr, then the level data LVL is determined to be 1*d* from the point of intersection with the profile LD. Practically, the profile LD is stored in the form of a one-dimensional table for example in a memory (not shown in drawings) such as a ROM provided in the computer 1100. The printer driver 1110 determines the level data by referencing this table.

In Step S302, it is determined whether or not the level data LVL that has been set as above is larger than the threshold value THL. Here, determination of whether the dots are on or off is performed using dithering. The threshold value THL is set to a different value for each pixel block of a so-called dither matrix. This embodiment uses a dither matrix in which a value from 0 to 254 is expressed for each square of a 16×16 square pixel block.

Figure 5:
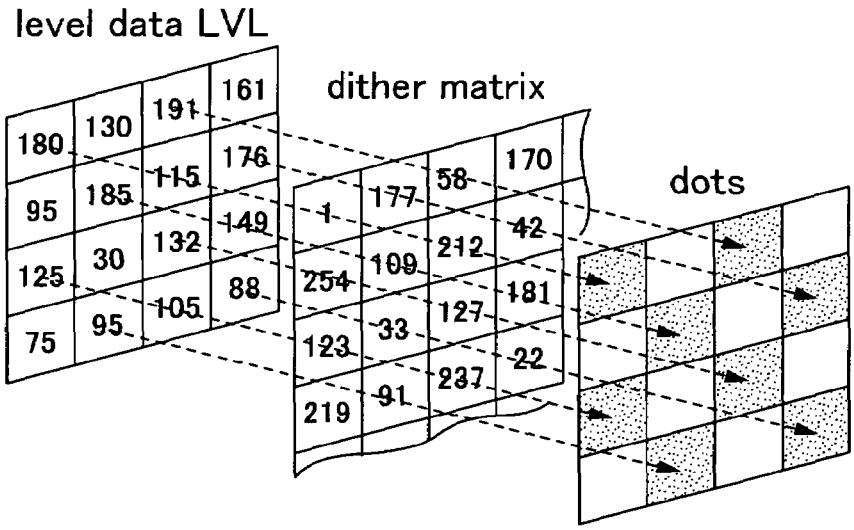
FIG. 5 is a diagram illustrating how dots are determined to be on or off through dithering.

FIG. 5 is a diagram illustrating how dots are determined to be on or of f through dithering. For the convenience of illustration, FIG. 5 shows only a portion of the K pixel data. First, the level data LVL of the K pixel data is compared with the threshold value THL of the pixel block on the dither matrix that corresponds to that K pixel data. Then, if the level data LVL is larger than the threshold value THL, the dot is set to on (that is, a dot is formed), and if the level data LVL is smaller, the dot is set to off (that is, no dot is formed). In this diagram, the pixel data of the shaded regions in the dot matrix is the K pixel data in which the dots are set to on. In other words, in Step S302, if the level data LVL is larger than the threshold value THL, then the procedure advances to Step S310, and otherwise the procedure advances to Step S303. Here, if the procedure advances to Step S310, then the printer driver 1110 stores the K pixel data being processed, assigning a value of "11" to indicate that the pixel data (2-bit data) expresses a large dot, and then the procedure advances to Step S311. Then, in Step S311, it is determined whether or not the processing of all of the K pixel data is finished, and if it is finished, then halftone processing is ended. On the other hand, if it is not finished, then the processing shifts to the K pixel data that has not yet been processed, and the procedure returns to Step S301.

If the procedure advances to Step S303, then the printer driver 1110 sets the level data LVM for medium dots. The level data LVM for medium dots is set by the creation ratio table noted above, based on the gradation value. The setting method for level data LVM for medium dots is the same as that for setting the large dot level data LVL. That is, in the example shown in FIG. 4, the level data LVM corresponding to the gradation value gr is found to be 2*d*, which is indicated by the point of intersection with the profile MD that indicates the medium dot creation ratio.

Next, in Step S304, the medium dot level data LVM is compared with the threshold value THM to determine whether or not the medium dot is on or off. The method by which dots are determined to be either on or off is the same that as that for large dots. However, when determining here whether medium dots are on or off, the threshold values THM used for this determination are set to values that are different from the threshold values THL for large dots. That is, if the dots are determined to be on or off using the same dither matrix for the large dots and the medium dots, then the pixel blocks where the dots are likely to be on will be the same in both cases. That is, there is a high possibility that when a large dot is off, the medium dot will also be off. As a result, there is a possibility that the creation ratio of medium dots will be lower than the desired creation ratio. In order to avoid this phenomenon, in the present embodiment there is a different dither matrix for large dots and medium dots. That is, by varying the pixel blocks that are likely to be on between the large dots and the medium dots, those dots are formed appropriately.

Figures 6A, 6B, 7:
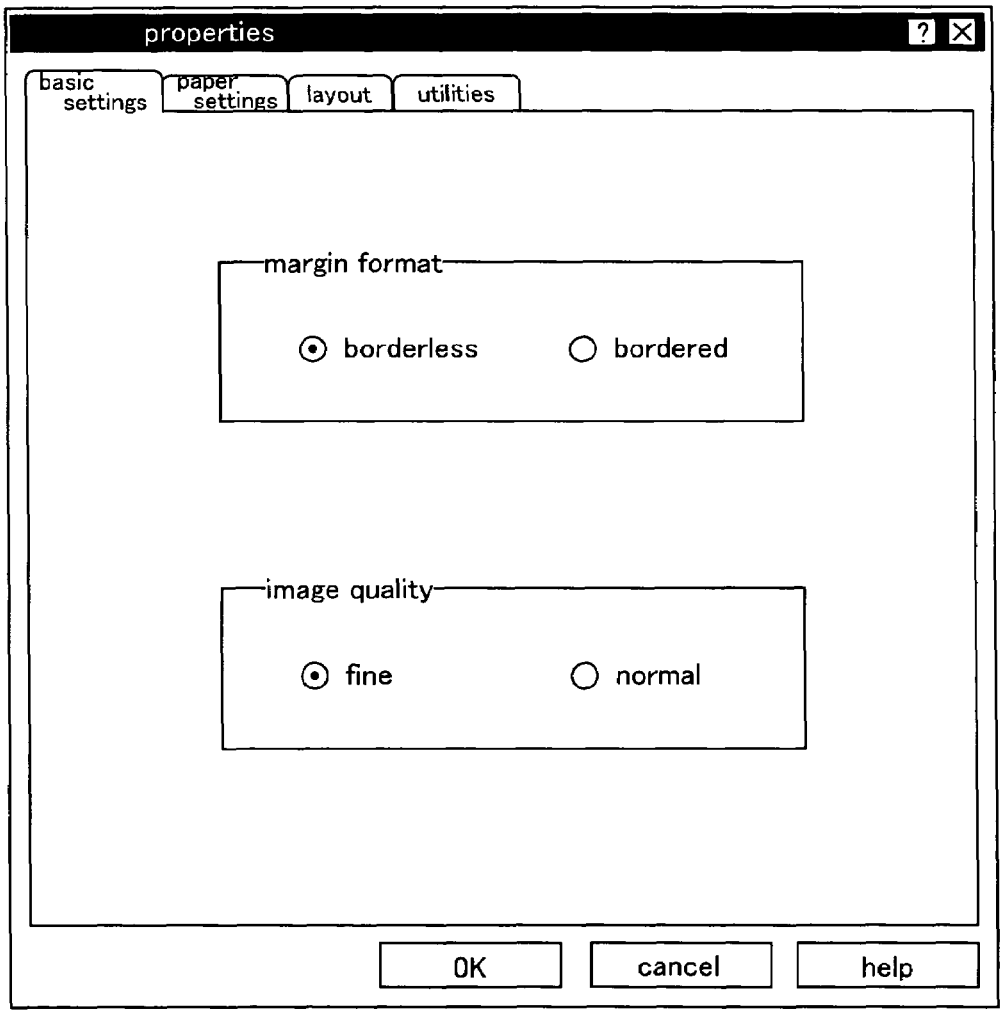
FIG. 6A shows a dither matrix used for determining large dots.
FIG. 6B shows a dither matrix used for determining medium dots.
FIG. 7 is an explanatory diagram of a user interface of a printer driver.

FIG. 6A and FIG. 6B show the relationship between the dither matrix that is used for determining large dots and the dither matrix that is used for determining medium dots. In this embodiment, a first dither matrix TM as shown in FIG. 6A is used for the large dots. Furthermore, a second dither matrix UM as shown in FIG. 6B is used for the medium dots. The second dither matrix UM is obtained by symmetrically mirroring the threshold values in the first dither matrix TM about the center in the carrying direction (the vertical direction in these diagrams). As explained previously, the present embodiment uses a 16×16 matrix, but for convenience of illustration, FIG. 6A and FIG. 6B show a 4×4 matrix. It should be noted that it is also possible to use completely different dither matrices for the large dots and medium dots.

Then, in Step S304, if the medium dot level data LVM is larger than the medium dot threshold value THM, then it is determined that the medium dot should be on, and the procedure advances to Step S309, and otherwise the procedure advances to Step S305. Here, if the procedure advances to Step S309, then the printer driver 1110 assigns a value of "10" to the K pixel data being processed, storing it as pixel data indicating a medium dot, and then the procedure advances to Step S311. Then, in Step S311, it is determined whether or not the processing of all of the K pixel data is finished, and if it is finished, then halftone processing is ended. On the other hand, if it is not finished, then the processing shifts to the K pixel data that has not yet been processed, and the procedure returns to Step S301.

If the procedure advances to Step S305, then the small dot level data LVS is set in the same way the level data of the large dots and the medium dots are set. It should be noted that the dither matrix for the small dots is preferably different from those for the medium dots and the large dots in order to prevent a reduction in the creation ratio of small dots.

Then, in Step S306, the printer driver. 1110 compares the level data LVS and the small dot threshold values THS, and if the value of the small dot level data LVS is larger than the value of the small dot threshold value THS, then the procedure advances to Step S308, and otherwise the procedure advances to Step S307. Here, if the procedure advances to Step S308, then a value of "01" for pixel data that indicates a small dot is assigned to the K pixel data being processed and the data is stored, and then the procedure advances to Step S311. Then, in Step S311, it is determined whether or not the processing of all of the K pixel data is finished, and if it is not finished, then the processing shifts to the K pixel data that has not yet been processed, and the procedure returns to Step S301. On the other hand, if it is finished, then halftone processing is ended.

If the procedure advances to Step S307, then the printer driver 1110 assigns a value of "00" to the K pixel data being processed and stores it as pixel data indicating the absence of a dot, and then the procedure advances to Step S311. Then, in Step S311, it is determined whether or not all of the K pixel data has been processed. If processing is not finished, then the processing shifts to the K pixel data that has not yet been processed, and the procedure returns to Step S301. On the other hand, if it is finished, then halftone processing is ended.

Regarding the Settings of the Printer Driver

FIG. 7 is an explanatory diagram of the user interface of the printer driver 1110. The user interface of the printer driver 1110 is displayed on the display device 1200 via the video driver 1102. The user can use the input device 1300 to change the various settings of the printer driver 1110. The settings for margin format mode and image quality mode are prearranged as the basic settings, and settings such as paper size mode are prearranged as the paper settings. Then, based on the settings made using the user interface, the printer driver 1110 distinguishes the print resolution and the size of the paper S.

===Configuration of the Printer===

Regarding the Configuration of the Printer

Figure 8:
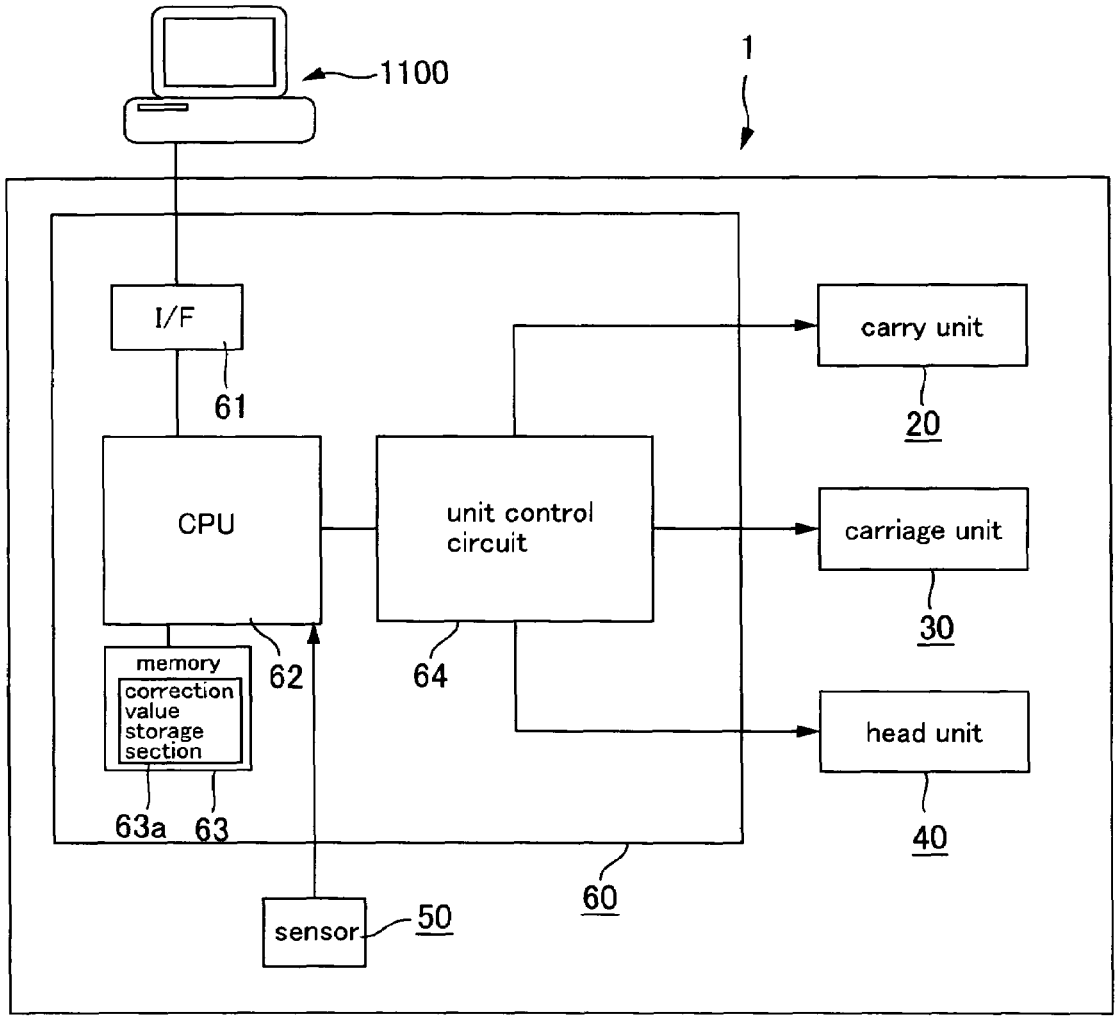
FIG. 8 is a block diagram of the overall configuration of a printer.
Figure 9:
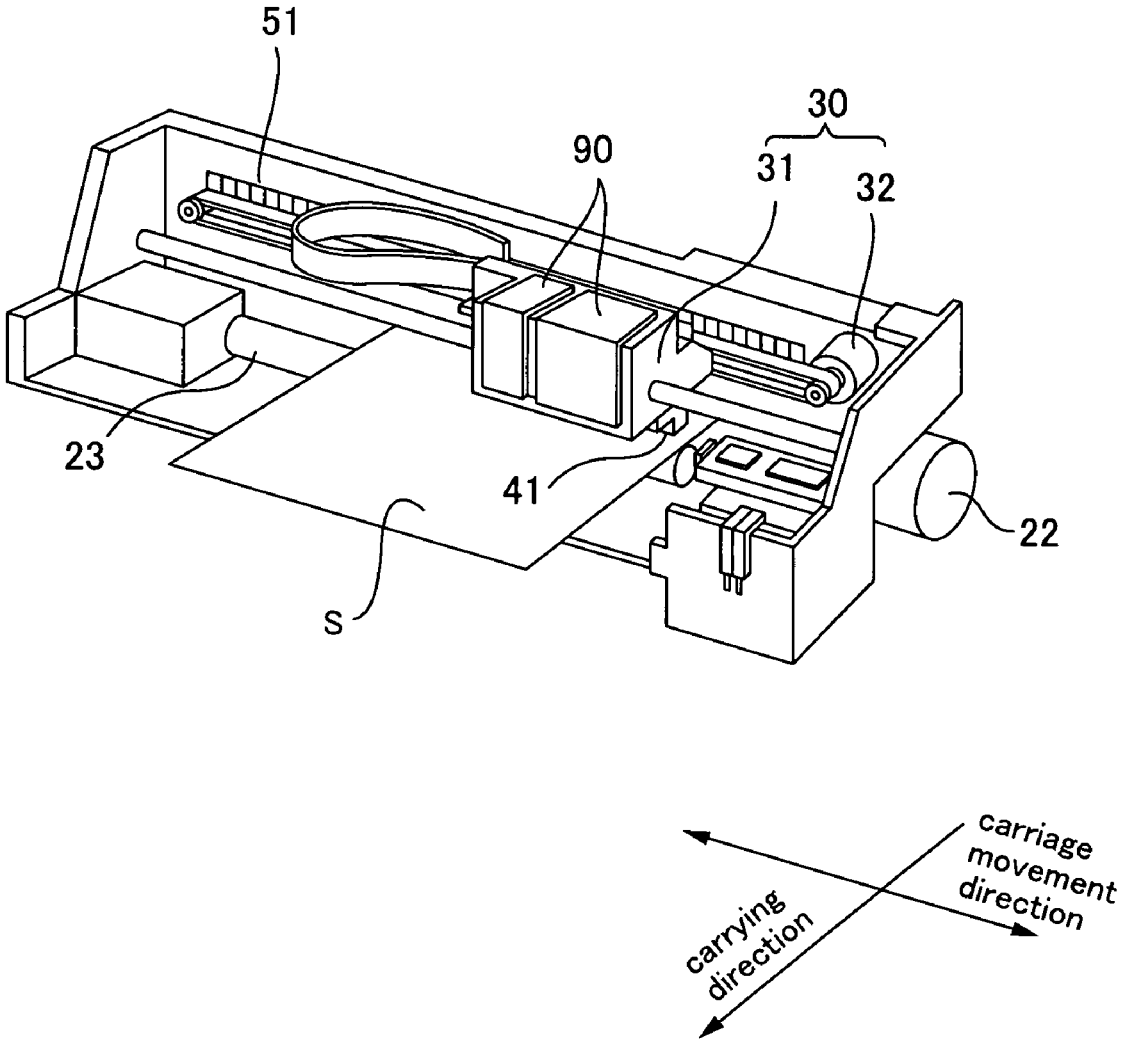
FIG. 9 is a schematic diagram of the overall configuration of the printer.
Figure 10:
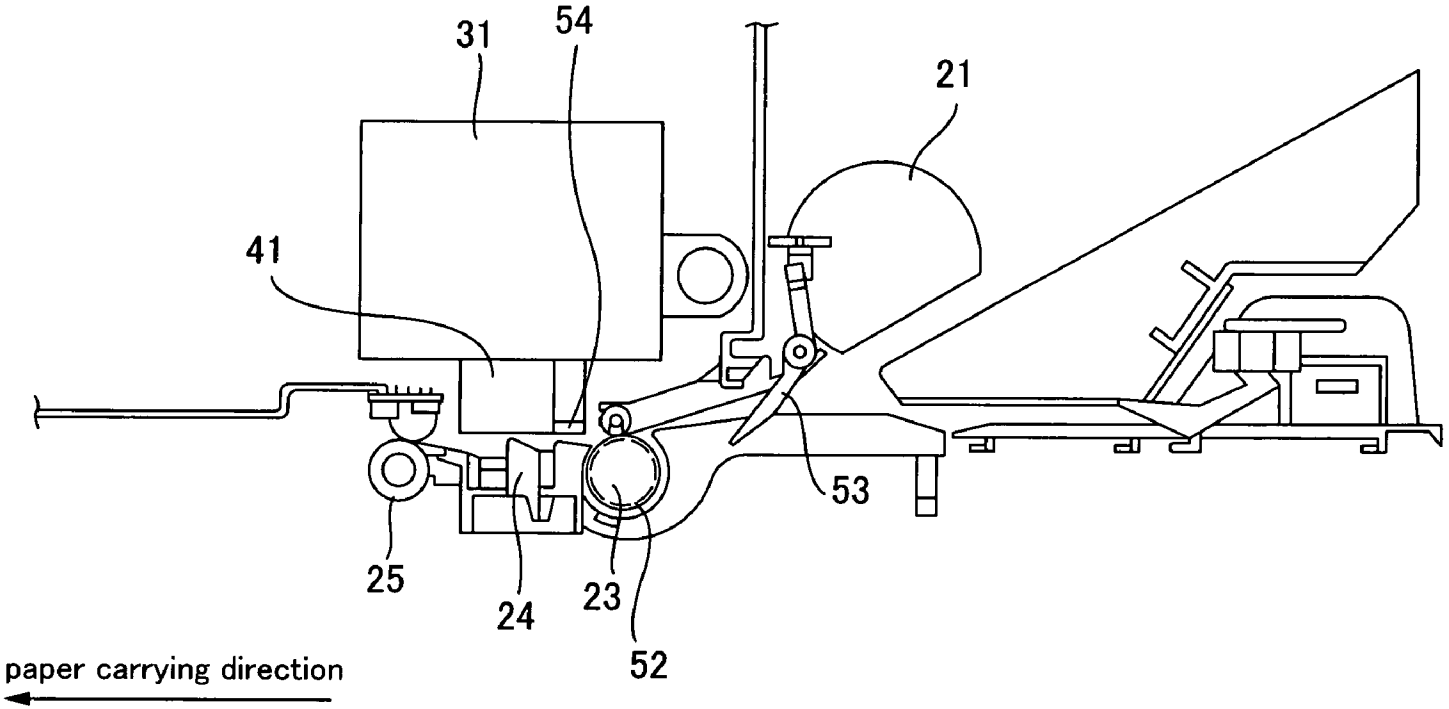
FIG. 10 is a lateral view of the overall configuration of the printer.

FIG. 8 is a block diagram of the overall configuration of the printer 1 of this embodiment. Further, FIG. 9 is a schematic diagram of the overall configuration of the printer 1 of this embodiment. Furthermore, FIG. 10 is lateral view of the overall configuration of the printer 1 of this embodiment. The basic structure of the printer 1 according to the present embodiment is described below using these diagrams.

The printer 1 of this embodiment has a carry unit 20, a carriage unit 30, a head unit 40, a sensor 50, and a controller 60. Having received print data from the computer 1100, which is an external device, the printer 1 controls the various units (the carry unit 20, the carriage unit 30, and the head unit 40) using the controller 60. The controller 60 controls the units in accordance with the print data that is received from the computer 1100 to print an image on the paper S. The sensor 50 monitors the conditions within the printer 1, and outputs the results of this detection to the controller 60. The controller 60 receives the detection results from the sensor 50, and controls the units based on these detection results.

The carry unit 20 is for delivering the paper S to a printable position, and for carrying the paper S by a predetermined carry amount in a predetermined direction (that is, the "carrying direction") during printing. Here, the carrying direction of the paper S is the direction that intersects the carriage movement direction described below, and corresponds to an "intersecting direction." The carrying direction can also be referred to as the "sub-scanning direction." For this reason, in the following description, positions in the carrying direction may also be referred to as "sub-scanning positions."

The carry unit 20 functions as a carrying mechanism for carrying the paper S and is provided with a paper supplying roller 21, a carry motor 22 (also referred to as "PF motor"), a carry roller 23, a platen 24, and a paper discharge roller 25. The paper supplying roller 21 is a roller for automatically supplying paper S that has been inserted into a paper insert opening into the printer 1. The paper supplying roller 21 has the cross-sectional shape of the letter D, and the length of its circumferential portion is set longer than the carry distance up to the carry roller 23. Thus, by rotating the paper supplying roller 21 with its circumferential portion abutting against the paper surface, the paper S can be carried up to the carry roller 23. The carry motor 22 is a motor for carrying paper S in the carrying direction, and is constituted by a DC motor for example. The carry roller 23 is a roller for carrying the paper S that has been supplied by the paper supplying roller 21 up to a printable region, and is driven by the carry motor 22. The platen 24 supports the paper S during printing from the rear surface side of the paper S. The paper discharge roller 25 is a roller for carrying the paper S for which printing has finished in the carrying direction. The paper discharge roller 25 is rotated in synchronization with the carry roller 23.

The carriage unit 30 is provided with a carriage 31 and a carriage motor 32 ("CR motor"). The carriage motor 32 is a motor for moving the carriage 31 back and forth in a predetermined direction (hereinafter, also referred to as "carriage movement direction"), and is constituted by a DC motor for example. The carriage 31 detachably holds ink cartridges 90 containing ink. A head 41 for ejecting ink from nozzles is attached to the carriage 31. Thus, by moving the carriage 31 back and forth, the head 41 and the nozzles also move back and forth in the carriage movement direction. Consequently, the carriage movement direction corresponds to the movement direction of the head 41 and the nozzles. It should be noted that the carriage movement direction can also be referred to as the "main-scanning direction."

The head unit 40 is for ejecting ink onto the paper S. The head unit 40 is provided with the head 41. The head 41 has a plurality of nozzles, and ejects ink intermittently from each of the nozzles. Raster lines are formed on the paper S due to the head 41 intermittently ejecting ink from the nozzles while moving in the carriage movement direction. Each raster line is constituted by a plurality of dots arranged along the carriage movement direction. Thus, the raster line corresponds to a line that is constituted by a plurality of dots. It should be noted that the configuration of the head 41, the drive circuit for driving the head 41, and the method for driving the head 41 are described later.

Figure 11:
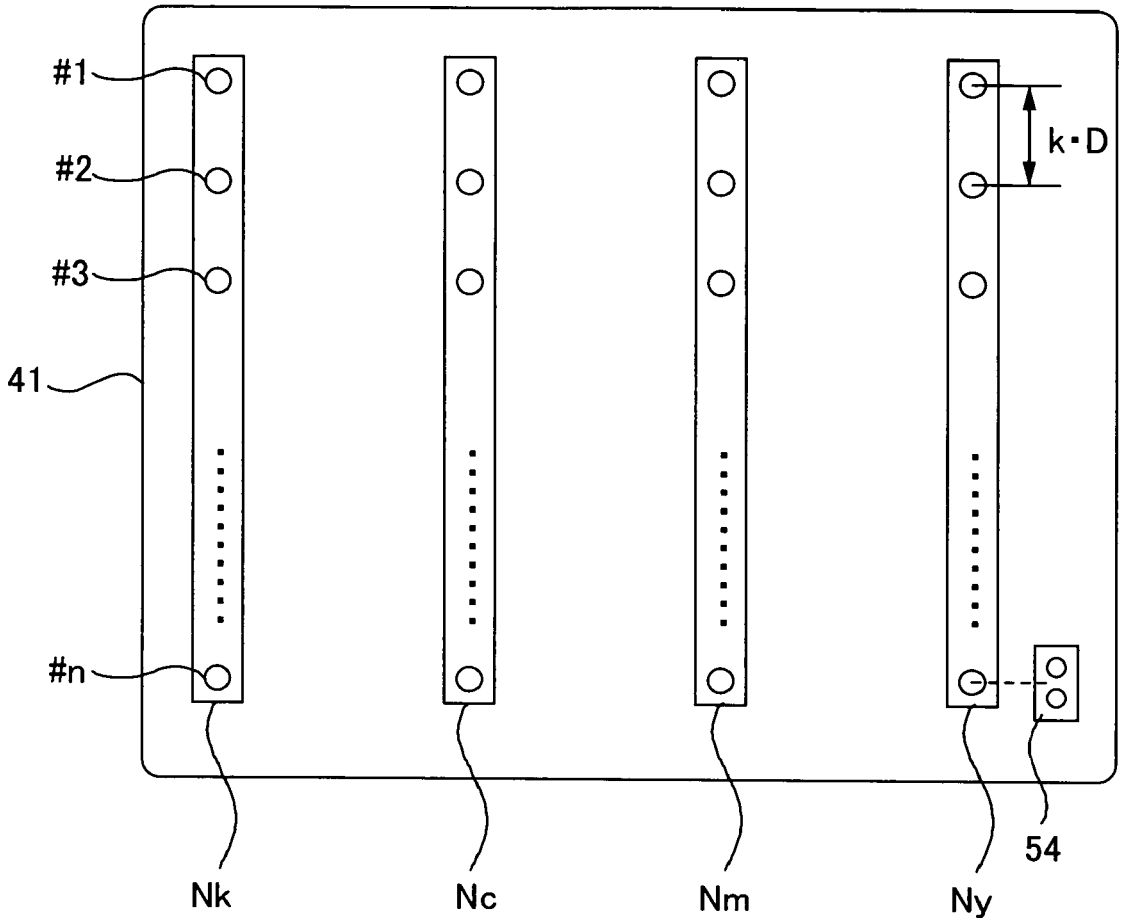
FIG. 11 is an explanatory diagram showing the arrangement of nozzles.
Figure 11:
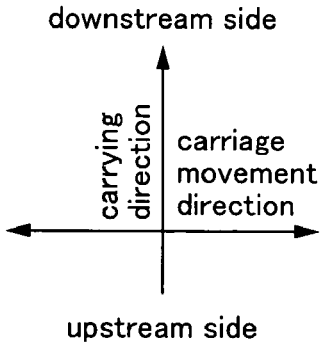

The sensor 50 includes components such as a linear encoder 51, a rotary encoder 52, a paper detection sensor 53, and a paper width sensor 54. The linear encoder 51 is for detecting the position of the carriage 31 (the head 41) in the carriage movement direction. The linear encoder 51 shown as an example here has a belt-shaped slit plate provided extending in the scanning direction, and a photo interrupter that is attached to the carriage 31 and detects the slits formed in the slit plate. The rotary encoder 52 is for detecting the amount of rotation of the carry roller 23, and has a disk-shaped slit plate that rotates in conjunction with rotation of the carry roller 23, and a photo interrupter for detecting the slits formed in the slit plate. The paper detection sensor 53 is for detecting the position of the leading edge of the paper S to be printed. The paper detection sensor 53 is provided at a position where it can detect the leading edge position of the paper S as the paper S is being carried toward the carry roller 23 by the paper supplying roller 21. It should be noted that the paper detection sensor 53 in this embodiment is a mechanical sensor that detects the leading edge of the paper S through a mechanical mechanism. The paper width sensor 54 is attached to the carriage 31. In the present embodiment, as shown in FIG. 11, the paper width sensor 54 is attached at substantially the same position as the most upstream side nozzle, with respect to its position in the carrying direction. The paper width sensor 54 is an optical sensor and receives light with a light-receiving section that receives the reflected light of light irradiated onto the paper S from a light-emitting section. The presence/absence of the paper S is detected based on the intensity of light received with the light-receiving section.

The controller 60 is a control unit for carrying out control of the printer 1. The controller 60 has an interface section 61, a CPU 62, a memory 63, and a unit control circuit 64. The interface section 61 is for exchanging data between the computer 1100, which is an external device, and the printer 1. The CPU 62 is an arithmetic processing unit for carrying out overall control of the printer. The memory 63 is for ensuring a working region and a region for storing computer programs for the CPU 62, for instance, and uses means such as a RAM, an EEPROM, or a ROM. The memory 63 constitutes a storage means (storage section). The CPU 62 controls the various units via the unit control circuit 64 in accordance with computer programs stored in the memory 63. In this embodiment, a partial region of the memory 63 is used as a correction value storage section 63*a* for storing correction values, which is described later.

Regarding the Configuration of the Head

FIG. 11 is an explanatory diagram showing the arrangement of the nozzles in the lower surface (that is, the surface facing the paper S) of the head 41. A black ink nozzle row Nk, a cyan ink nozzle row Nc, a magenta ink nozzle row Nm, and a yellow ink nozzle row Ny are formed in the lower surface of the head 41. Each nozzle row is provided with n (for example, 180) nozzles, which are ejection openings for ejecting the various color inks. The plurality of nozzles in each nozzle row are arranged in a row at a constant spacing (nozzle pitch: k·D) in the carrying direction. Here, D is the minimum dot pitch in the carrying direction, that is, the spacing at the highest resolution of the dots that can be formed on the paper S. Also, k is an integer of 1 or more. For example, if the nozzle pitch is 180 dpi (1/180 inch) and the dot pitch in the carrying direction is 720 dpi (1/720 inch), then k=4. In the example shown here, the nozzles of the nozzle rows are assigned numbers that become smaller toward the nozzles on the downstream side (#1 to #n). That is, the nozzle #1 is positioned more downstream (that is, on the upper edge side of the paper S) in the carrying direction than the nozzle #n.

By providing such nozzles rows in the head 41, the region in which dots are formed by a single dot formation operation is widened, allowing the printing time to be reduced. Also, these nozzle rows are provided for each color of ink, and thus by suitably ejecting ink droplets from these nozzle rows it is possible to perform multi-color printing. Also, pressure chambers (not shown) are each provided on the ink paths that are linked to the nozzles. In each pressure chamber, for example a piezo element (not shown) is provided that serves as a drive element for causing ink droplets to be ejected from the respective nozzle.

Regarding the Driving of the Head

Figure 12:
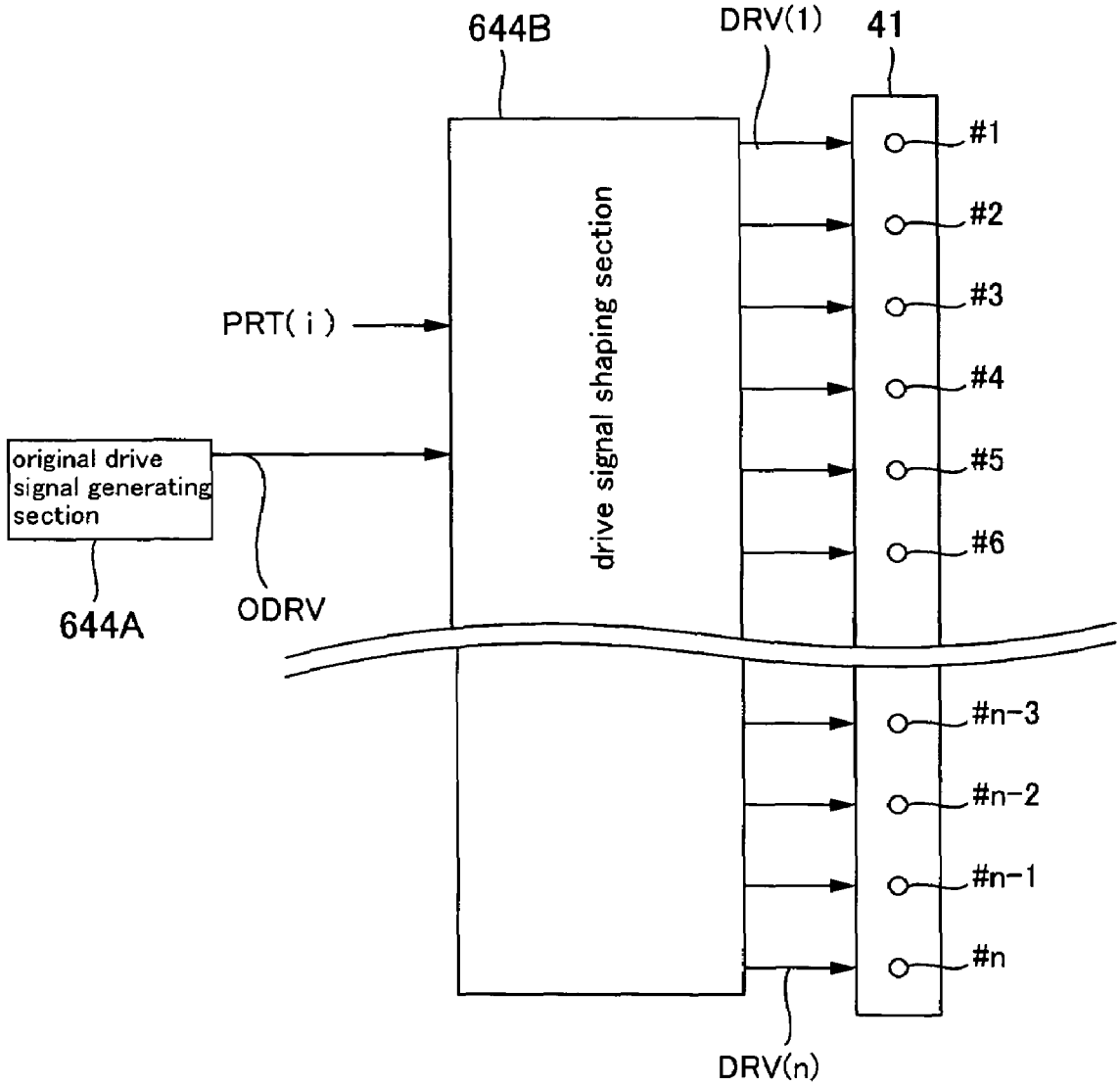
FIG. 12 is an explanatory diagram of a drive circuit of a head unit.

FIG. 12 is an explanatory diagram of the drive circuit of the head 41. This drive circuit is provided within the unit control circuit 64 mentioned above. As shown in the diagram, the drive circuit is provided with an original drive signal generating section 644A and a drive signal shaping section 644B. In this embodiment, a drive circuit is provided for each nozzle row, that is, for each nozzle row of the colors black (K), cyan (C), magenta (M), and yellow (Y), such that the piezo elements are driven individually for each nozzle row. It should be noted that the number in parentheses at the end of the name of each of the signals in the diagram indicates the number of the nozzle to which that signal is supplied.

The above-mentioned piezo element deforms each time drive pulses W1 and W2 (see FIG. 13) are supplied, such that the pressure on the ink inside the pressure chamber is altered. That is, when a voltage of a predetermined time duration is applied between electrodes provided at both ends of the piezo element, the piezo element becomes deformed for the time duration of voltage application and deforms an elastic membrane (lateral wall) partitioning a portion of the pressure chamber. The volume of the pressure chamber changes in accordance with this deformation of the piezo element, and due to this change in pressure chamber volume the pressure on the ink within the pressure chamber is altered. Then, due to this change in pressure on the ink, an ink droplet is ejected from the corresponding nozzle #1 to #180.

The original drive signal generating section 644A generates an original drive signal ODRV that is used in common by the nozzles #1 to #n. The original drive signal ODRV of the present embodiment is a signal that includes a plurality of the pulses W1 and W2 during the main-scanning period of a single pixel (the time during which a single nozzle crosses over a square box corresponding to a single pixel). The drive signal shaping section 644B receives an original drive signal ODRV from the original drive signal generating section 644A together with a print signal PRT(i). The drive signal shaping section 644B shapes the original drive signal ODRV in correspondence with the level of the print signal PRT(i) and outputs it toward the piezo elements of the nozzles #1 to #n as a drive signal DRV(i). The piezo elements of the nozzles #1 to #n are driven in accordance with the drive signal DRV from the drive signal shaping section 644B.

Regarding Drive Signals of the Head

Figure 13:
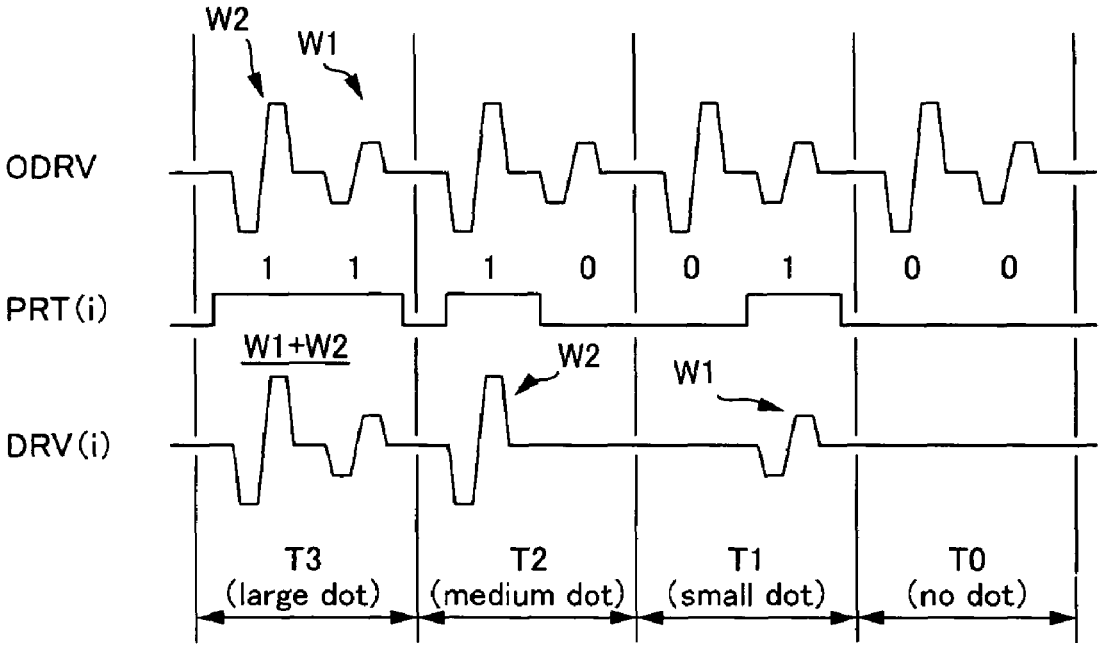
FIG. 13 is a timing chart illustrating the various signals.

FIG. 13 is a timing chart illustrating the various signals. This drawing shows a timing chart for the various signals, namely the original drive signal ODRV, the print signal PRT(i), and the drive signal DRV(i).

As discussed above, the original drive signal ODRV is a signal used in common for the nozzles #1 to #n, and is output from the original drive signal generating section 644A to the drive signal shaping section 644B. In this embodiment, the original drive signal ODRV includes two drive pulses, namely a first pulse W1 and a second pulse W2, in the period during which a single nozzle crosses over the length of one pixel. The first pulse W1 is a drive pulse for causing a small size ink droplet (hereinafter, called small ink droplet) to be ejected from the nozzle. The second pulse W2 is a drive pulse for causing a medium size ink droplet (hereinafter, called medium ink droplet) to be ejected from the nozzle. That is, by supplying the first pulse W1 to the piezo element, a small ink droplet is ejected from the nozzle. When this small ink droplet lands on the paper S, a small size dot (small dot) is formed. Likewise, by supplying the second pulse W2 to the piezo element, a medium ink droplet is ejected from the nozzle. When this medium ink droplet lands on the paper S, a medium size dot (medium dot) is formed.

The print signal PRT(i) is a signal corresponding to the pixel data allocated to a single pixel. That is, the print signal PRT(i) is a signal corresponding to the pixel data included in the print data. In this embodiment, the print signals PRT(i) are signals having two bits of information per pixel. The drive signal shaping section 644B shapes the original drive signal ODRV in correspondence with the signal level of the print signal PRT(i), and outputs a drive signal DRV(i).

The drive signal DRV is a signal that is obtained by blocking the original drive signal ODRV in correspondence with the level of the print signal PRT(i). That is, when the level of the print signal PRT(i) is "1" then the drive signal shaping section 644B allows the corresponding drive pulse of the original drive signal ODRV to pass unchanged and sets it as the drive signal DRV(i). On the other hand, when the level of the print signal PRT(i) is "0," the drive signal shaping section 644B blocks the drive pulse of the original drive signal ODRV. Then, the drive signal DRV(i) from the drive signal shaping section 644B is individually supplied to the corresponding piezo element. The piezo elements are driven according to the drive signals DRV(i) that are supplied to them.

When the print signal PRT(i) corresponds to the two bits of data "01" then only the first pulse W1 is output in the first half of the single pixel period. Accordingly, a small ink droplet is ejected from the nozzle, forming a small dot on the paper S. When the print signal PRT(i) corresponds to the two bits of data "10" then only the second pulse W2 is output in the second half of the single pixel period. Accordingly, a medium ink droplet is output from the nozzle, forming a medium dot on the paper S. When the print signal PRT(i) corresponds to the two bits of data "11" then both the first pulse W1 and the second pulse W2 are output during the single pixel period. Accordingly, a small ink droplet and a medium ink droplet are successively ejected from the nozzle, forming a large size dot (large dot) on the paper S. It should be noted that when the print signal PRT(i) corresponds to the two bits of data "00", then neither the first pulse W1 or the second pulse W2 are output during the single pixel period. In this case, no ink droplet of any size is ejected from the nozzle, and no dot is formed on the paper S.

As described above, the drive signal DRV(i) in a single pixel period is shaped so that it may have four different waveforms corresponding to the four different values of the print signal PRT(i) Here, in the present embodiment, the content of the two-bit pixel data matches the content of the print signals. In other words, for all pixel data and print signals, non-formation of a dot is given by the two-bit data "00" and formation of a small dot is given by the two-bit data "01." Also, formation of a medium dot is given by the two-bit data "10" and formation of a large dot is given by the two-bit data "11." Consequently, the drive circuits of the head 41 use the pixel data included in the print data as the print signal PRT(i).

Regarding the Printing Operation

Figure 14:
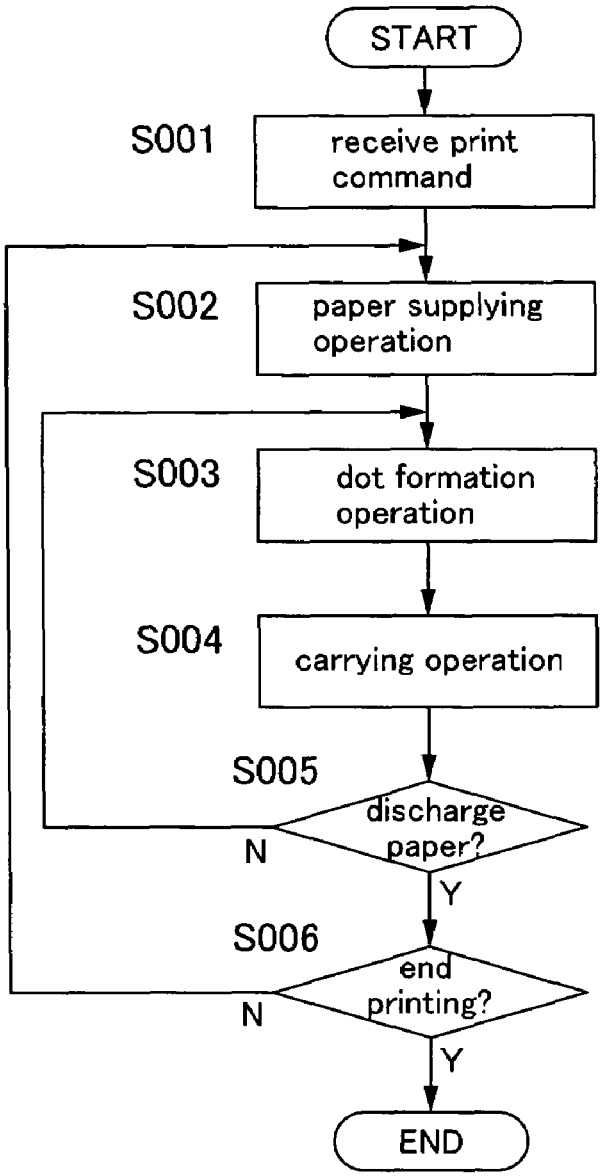
FIG. 14 is a flowchart of the operation during printing.

FIG. 14 is a flowchart of the operations during printing. The various operations that are described below are achieved by the controller 60 controlling the various units in accordance with a computer program stored in the memory 63. This computer program includes codes for executing the various processes.

Receive Print Command (S001): The controller 60 receives a print command via the interface section 61 from the computer 1100. This print command is included in the header of the print data transmitted from the computer 1100. The controller 60 then analyzes the content of the various commands included in the print data that has been received and uses the various units to perform the following paper supply operation, carrying operation, and dot formation operation, for example.

Paper Supplying Operation (S002): Next, the controller 60 performs the paper supplying operation. The paper supplying operation is an operation for moving the paper S, which is the object to be printed, and positioning it at a print start position (the so-called indexed position). That is, the controller 60 rotates the paper supplying roller 21 to feed the paper S to be printed up to the carry roller 23. Then, the controller 60 rotates the carry roller 23 to position the paper S that has been fed from the paper supplying roller 21 at the print start position. It should be noted that when the paper S has been positioned at the print start position, at least some of the nozzles of the head 41 are in opposition to the paper S.

Dot Formation Operation (S003): Next, the controller 60 performs the dot formation operation. The dot formation operation is an operation for intermittently ejecting ink from the head 41 moving in the carriage movement direction, so as to form dots on the paper S. The controller 60 drives the carriage motor 32 and moves the carriage 31 in the carriage movement direction. Also, the controller 60 causes ink droplets to be ejected from the head 41 (nozzles) in accordance with the print data while the carriage 31 is moving. Then, as mentioned above, when ink droplets ejected from the head 41 land on the paper S, dots are formed on the paper S. That is to say, raster lines are formed on the paper by this dot formation operation.

Carrying Operation (S004): Next, the controller 60 performs the carrying operation. The carrying operation is an operation for moving the paper S relative to the head 41 in the carrying direction. The controller 60 drives the carry motor 22 to rotate the carry roller 23 and thereby carry the paper S in the carrying direction. Through this carrying operation, the head 41 becomes able to form dots at positions (sub-scanning positions) that are different from the positions of the dots formed in the preceding dot formation operation.

Paper Discharge Determination (S005): Next, the controller 60 determines whether or not to discharge the paper S that is being printed. In this determination, the paper is not discharged if there is still data to be printed on the paper S that is being printed. In this case, the controller 60 repeats in alternation the dot formation operation and the carrying operation until there is no longer any data for printing, gradually printing an image made of dots (raster lines) on the paper S. When there is no longer any data for printing on the paper S that is being printed, the controller 60 discharges that paper S. That is, the controller 60 discharges the printed paper S to the outside by rotating the paper discharge roller 25. It should be noted that whether or not to discharge the paper can also be determined based on a paper discharge command that is included in the print data.

Determination Whether Printing is Finished (S006): Next, the controller 60 determines whether or not to continue printing. If the next sheet of paper S is to be printed, then printing is continued and the paper supplying operation for the next sheet of paper S is started. If the next sheet of paper S is not to be printed, then the printing operation is ended.

===Regarding the Print Modes===

Figure 15A:
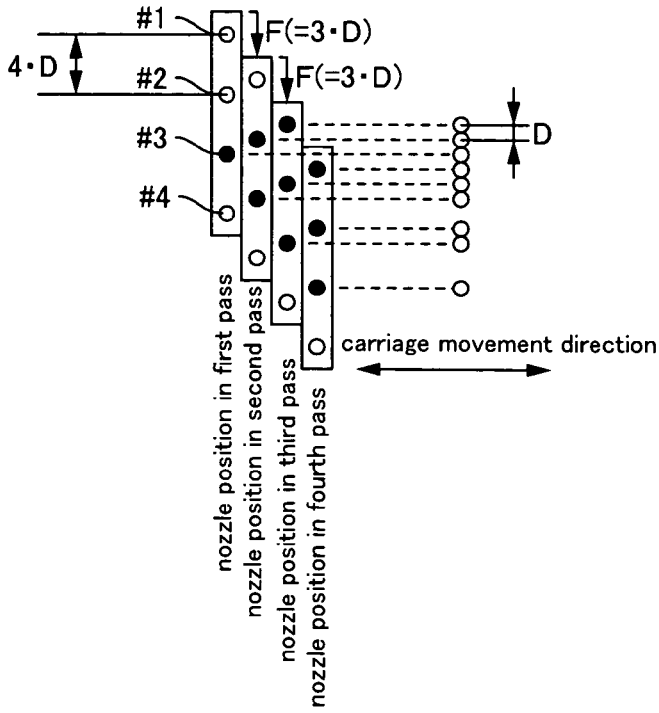
FIG. 15A is an explanatory diagram of the interlaced mode.
Figure 15B:
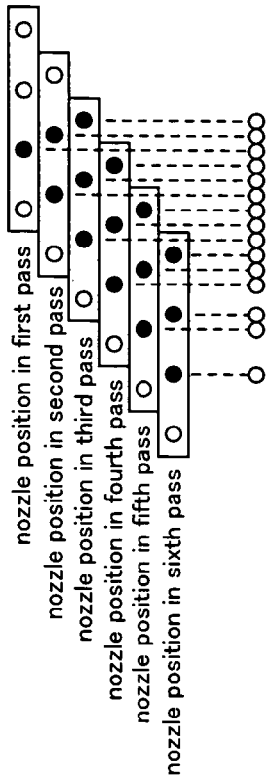
FIG. 15B is another explanatory diagram of the interlaced mode.

With the printer 1 of the present embodiment having such a structure, printing can be carried out the using interlaced mode. By using the interlaced mode, individual differences between the nozzles such as in the ink ejection properties are lessened by spreading them out over the image to be printed. FIG. 15A is an explanatory diagram of the interlaced mode. FIG. 15B is another explanatory diagram of the interlaced mode. A printing method using the interlaced mode is described below.

It should be noted that in FIGS. 15A and 15B, the nozzle rows shown in place of the head 41 are illustrated so as to appear moving with respect to the paper S, but this is merely for illustrative reasons. That is to say, these diagrams are for showing the relative positional relationship between the nozzle rows and the paper S, and in fact it is the paper S that moves in the carrying direction. Furthermore, in the diagrams, the nozzles represented by black circles are the nozzles that actually eject ink, and the nozzles represented by white circles are nozzles that do not eject ink.

Additionally, FIG. 15A shows the nozzle positions in the first pass to the fourth pass and the condition of dots formed by the nozzles. FIG. 15B shows the nozzle positions in the first pass to the sixth pass and the condition of dots formed by the nozzles. Here, "pass" refers to a single movement of the nozzle rows in the carriage movement direction.

With the interlaced mode illustrated in FIG. 15A and FIG. 15B, each time the paper S is carried in the carrying direction by a constant carry amount F, the nozzles form a raster line immediately above the raster line that was recorded in the pass immediately prior. In order to form the raster lines in this way using a constant carry amount, the number Nn (integer) of nozzles that actually eject ink is set to be coprime to k, and the carry amount F is set to Nn·D.

In the example shown in these drawings, the nozzle row has four nozzles lined up along the carrying direction, but in order to form raster lines by using a constant carry amount, the interlaced mode is carried out using three nozzles. Furthermore, because three nozzles are used, the paper S is carried by a carry amount 3·D. As a result, for example a nozzle row with a nozzle pitch of 180 dpi (4·D) is used to form dots on the paper S at a dot pitch of 720 dpi (=D).

The example in these diagrams shows the manner in which consecutive raster lines are formed, with the first raster line being formed by the nozzle #1 in the third pass, the second raster line being formed by the nozzle #2 in the second pass, the third raster line being formed by the nozzle #3 in the first pass, and the fourth raster line being formed by the nozzle #1 in the fourth pass. After this, raster lines are formed successively by the same operation as shown in FIG. 15B.

===Regarding the Cause of Darkness Non-Uniformities in Images===

Darkness non-uniformities that occur in a multicolor image printed using CMYK inks are generally due to darkness non-uniformities that occurs in each of those ink colors. For this reason, the method that is normally adopted is to inhibit darkness non-uniformities in images printed in multiple colors by separately inhibiting darkness non-uniformities in each of the ink colors.

Figure 16:
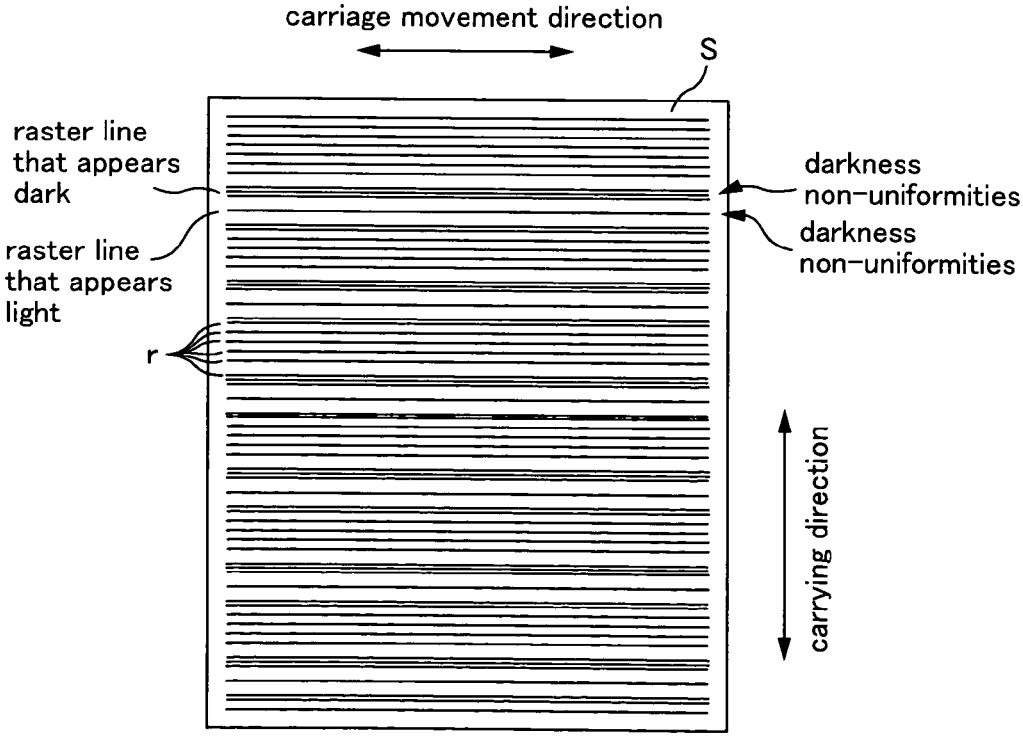
FIG. 16 is a diagram schematically illustrating darkness non-uniformities occurring in the carrying direction of the paper.

The following is a description of how darkness non-uniformities occur in images printed in a single color. Here, FIG. 16 is a diagram for schematically describing darkness non-uniformities that occur in an image printed in a single color and that occur in the carrying direction of the paper S. This diagram shows the darkness non-uniformities in an image that has been printed in one of the ink colors from CMYK, for example black ink.

The darkness non-uniformities in the carrying direction that is illustrated in FIG. 16 appear as bands parallel to the carriage movement direction (for convenience, these are also referred to as "horizontal bands"). These horizontal bands of darkness non-uniformities occur, for example, due to variations in the amounts of ink ejection between nozzles, but they can also occur due to variations in the travel direction of the ink. That is to say, when there is variation in the travel direction, the positions of the dots that are formed by the ink that lands on the paper S deviate in the carrying direction from their target formation positions.

In this case, the formation position of the raster line r that is constituted by these dots also deviates from the target formation position with respect to the carrying direction. Thus, the spacing between raster lines r that are adjacent to each other in the carrying direction becomes wider or narrower. When viewed macroscopically, these appear as darkness non-uniformities in horizontal bands. In other words, adjacent raster lines r with a relatively wide spacing between them macroscopically appear light, whereas raster lines r with a relatively narrow spacing between them macroscopically appear dark. It should be noted that deviation in the travel direction of ink is caused, for example, by deviation in the processing precision of the nozzles.

It should also be noted that these factors causing darkness non-uniformities also apply to the other ink colors as well. As long as even one color of the colors CMYK has this tendency, darkness non-uniformities will appear in an image printed in multiple colors.

Regarding the Method of a Reference Example for Inhibiting Darkness Non-Uniformities The method of a reference example for inhibiting darkness non-uniformities is described. In the method of the reference example here, a correction pattern of a predetermined darkness is first printed on the paper S, then the darkness of the raster lines that constitute the correction pattern is measured. Next, a correction value for each raster line is obtained based on the darkness of that raster line. Then, when an image is actually printed, the darkness of each raster line is adjusted using the thus-obtained correction value. For example, when the darkness of a particular raster line in the correction pattern is lighter than prescribed, the amount of ink ejected from the nozzle responsible for that raster line is increased at the time of the actual printing. On the other hand, when the darkness of a particular raster line in the correction pattern is darker than prescribed, the amount of ink ejected from the nozzle responsible for that raster line is decreased at the time of the actual printing.

Figure 17A:
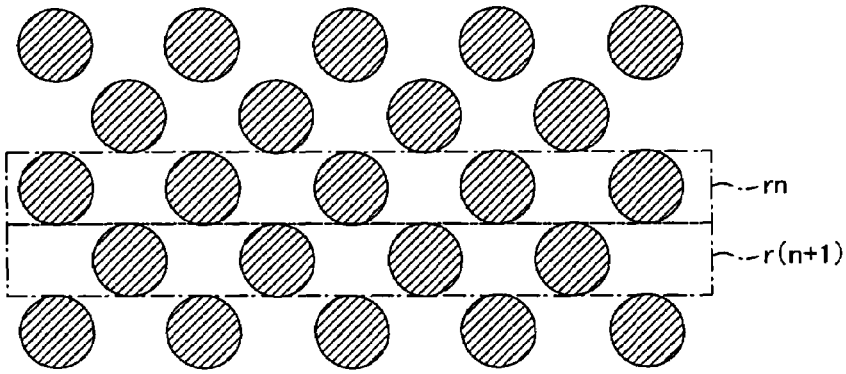
FIG. 17A is a diagram illustrating raster lines formed under ideal conditions.
Figure 17B:
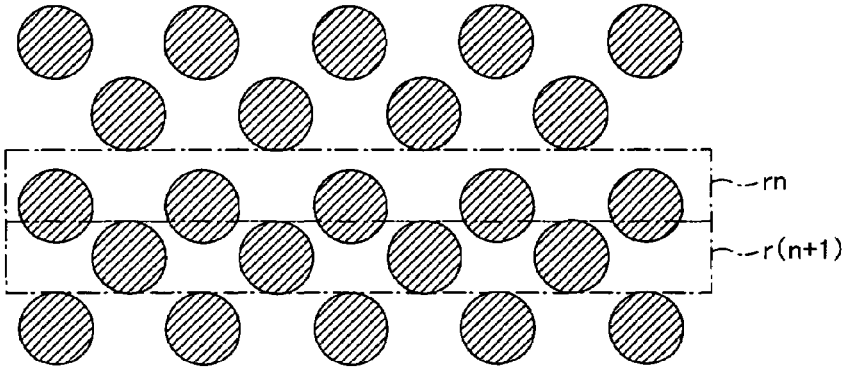
FIG. 17B is a diagram illustrating how a raster line formed by a particular nozzle deviates in the carrying direction.
Figure 17C:
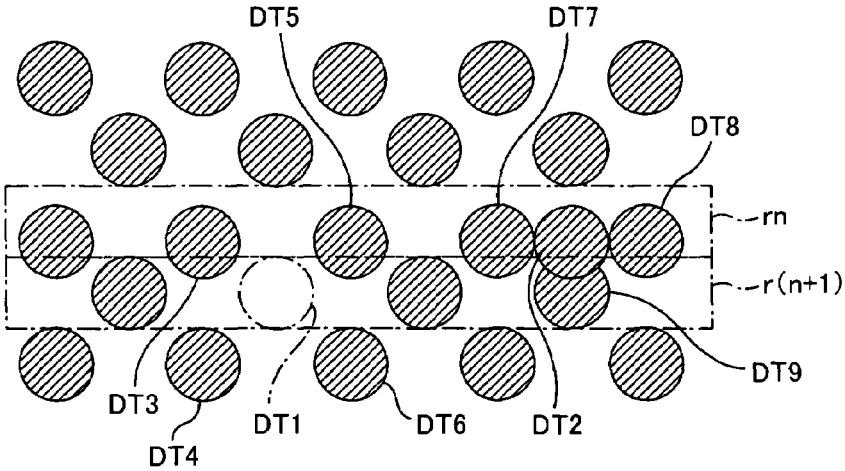
FIG. 17C is a diagram illustrating a corrected state achieved by a method of a reference example.

Although the method in this reference example is effective in inhibiting darkness non-uniformities in an image, it creates a new problem in that the graininess of the image is adversely affected. This new problem is described below. Here, FIG. 17A is a diagram illustrating raster lines formed under ideal conditions. FIG. 17B is a diagram illustrating how a raster line formed by a particular nozzle deviates in the carrying direction. FIG. 17C is a diagram illustrating a corrected state that is achieved by the method of the reference example. It should be noted that the image is formed at an intermediate color tone in these diagrams. For this reason, dots that are adjacent in the main-scanning direction are formed having a spacing of one dot between dots.

In the image of FIG. 17B, the dots that constitute a raster line rn are formed at positions closer to the adjacent raster line r (n+1) than the correct positions (that is, the positions of FIG. 17A). Macroscopically, this makes the raster line rn appear lighter than the correct darkness, and the raster line r (n+1) appear darker than the correct darkness. Then, with the method of the reference example, corrections are made for each raster line by determining the darkness/lightness, and therefore the raster line that appears darker will have its darkness made lighter by, for example, decimating dots, and the raster line that appears lighter will have its darkness made darker by, for example, adding dots. For this reason, in the example shown in FIG. 17C, a dot DT1 stays unformed in the raster line r (n+1) and a dot DT2 is added to the raster line rn.

The condition of the density of the dots and also the graininess is changed by these corrections. For example, in the example of FIG. 17C, by not forming the dot DT1, a region in which no dot is formed is made between the dots DT3 to DT6, which surround the dot DT1. For this reason, this region will appear as though the area of the background color has increased and the dots are formed coarsely. On the other hand, by forming the new dot DT2, the dot DT2 and dots DT7 to DT9 are formed in a clustered state. As a result, the dot DT2 and dots DT7 to DT9 appear as a single lump of a large dot.

Figure 18A:
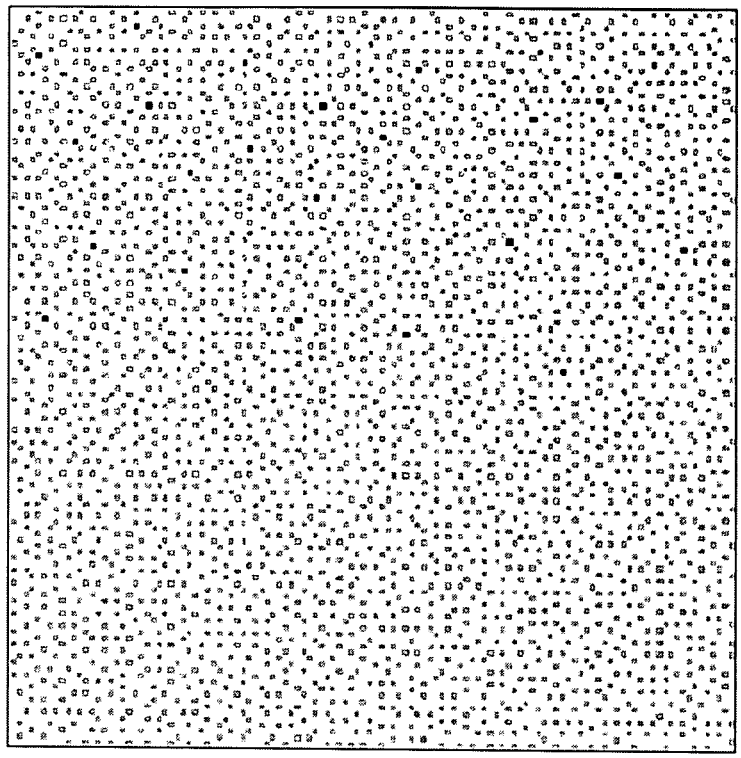
FIG. 18A is an image before correction in the reference example.
Figure 18B:
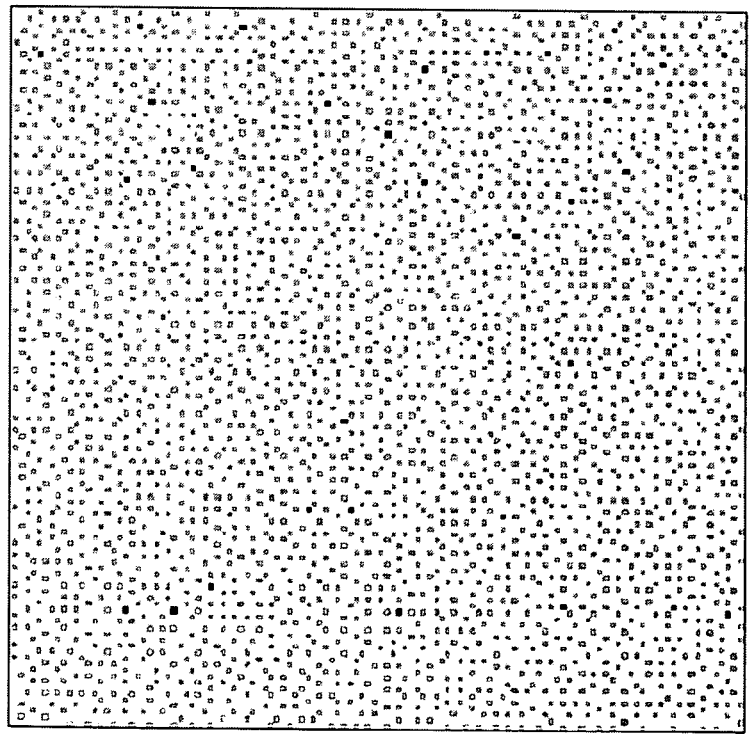
FIG. 18B is an image after correction in the reference example.

As a result, for example, the image shown in FIG. 18A (hereinafter referred to as "pre-correction image") is corrected and becomes the image shown in FIG. 18B (hereinafter, referred to as "corrected image"). When comparing these images, regarding the dots, the corrected image of FIG. 18B becomes more decimated than the pre-correction image of FIG. 18A. Furthermore, the lumps of dots shown as dark points are larger in number in the corrected image than the pre-correction image.

When drastic variations in darkness occur between adjacent raster lines, this phenomenon becomes conspicuous.

===Regarding the Printing Method of the Present Embodiment===

Main Features of the Printing Method of the Present Embodiment

In light of these circumstances, in the present embodiment, a correction value for correcting the darkness in the carrying direction of the image is set for each raster line. To set the correction values, a correction pattern (test pattern) is first printed on the paper S, then the darkness of each of the raster lines, that constitute the printed correction pattern, is measured. Then, the correction value for each raster line is set based on the darkness of a plurality of raster lines, of among the raster line group that constitutes the correction pattern, including the raster line that is to be set.

When carrying out printing of the image using correction values that have been set in this way, the correction values are set based on the results of actual printing, and therefore, even if the order of nozzles responsible for the individual raster lines is different from the arrangement in the head 41, each raster line can be formed with the desired darkness. Furthermore, to set the correction value for a particular raster line, the darkness of other raster lines in the correction pattern is taken into account, and therefore the darkness is smoothed out by the amount this is taken into account. For this reason, it is possible to prevent abrupt changes between adjacent raster lines in terms of the correction values that are set. As a result, it is possible to prevent the darkness of any particular raster line from being excessively corrected. Accordingly, this inhibits darkness non-uniformities, prevents graininess from being adversely affected, and improves the quality of printed images.

Regarding the Method for Printing an Image According to the Present Embodiment

Figure 19:
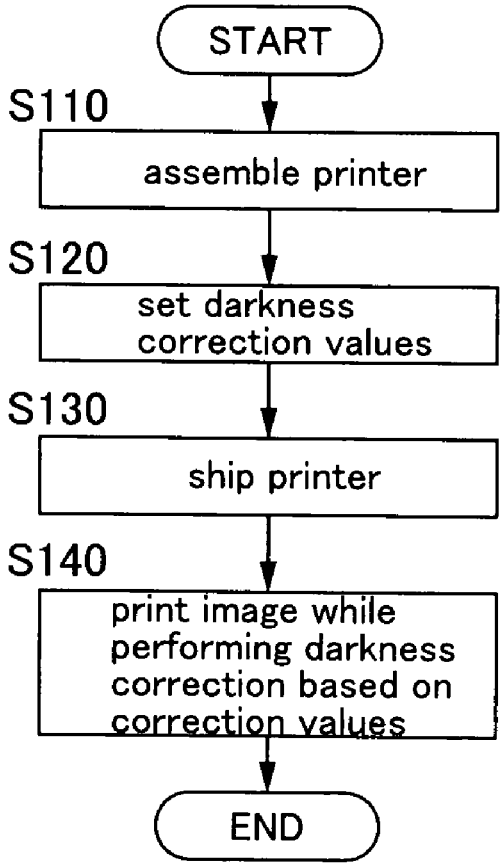
FIG. 19 is a flowchart showing a flow of processes etc. related to a method for printing an image according to a first embodiment.

FIG. 19 is a flowchart showing a flow of processes etc. related to a method for printing an image according to the present embodiment. An outline of the steps is described below with reference to this flowchart. First, the printer 1 is assembled on the manufacturing line (S110). Next, a worker on the inspection line sets, to the printer 1, correction values for correcting the darkness (S120). The correction values that are obtained here are stored in the memory 63, more specifically the correction value storage section 63*a* (see FIG. 8) provided in the memory 63, of the printer 1. Next, the printer 1 is shipped (S130). Then, a user that has purchased the printer 1 performs actual printing of an image, and at the time of this actual printing, the printer 1 prints an image on the paper S while performing darkness correction for each raster line based on the correction values (S140). A feature of the method for printing an image according to the present embodiment resides in the correction value setting step (Step S120) and the actual printing of the image (Step S140). Accordingly, the Step S120 and Step S140 are described below.

Figure 20:
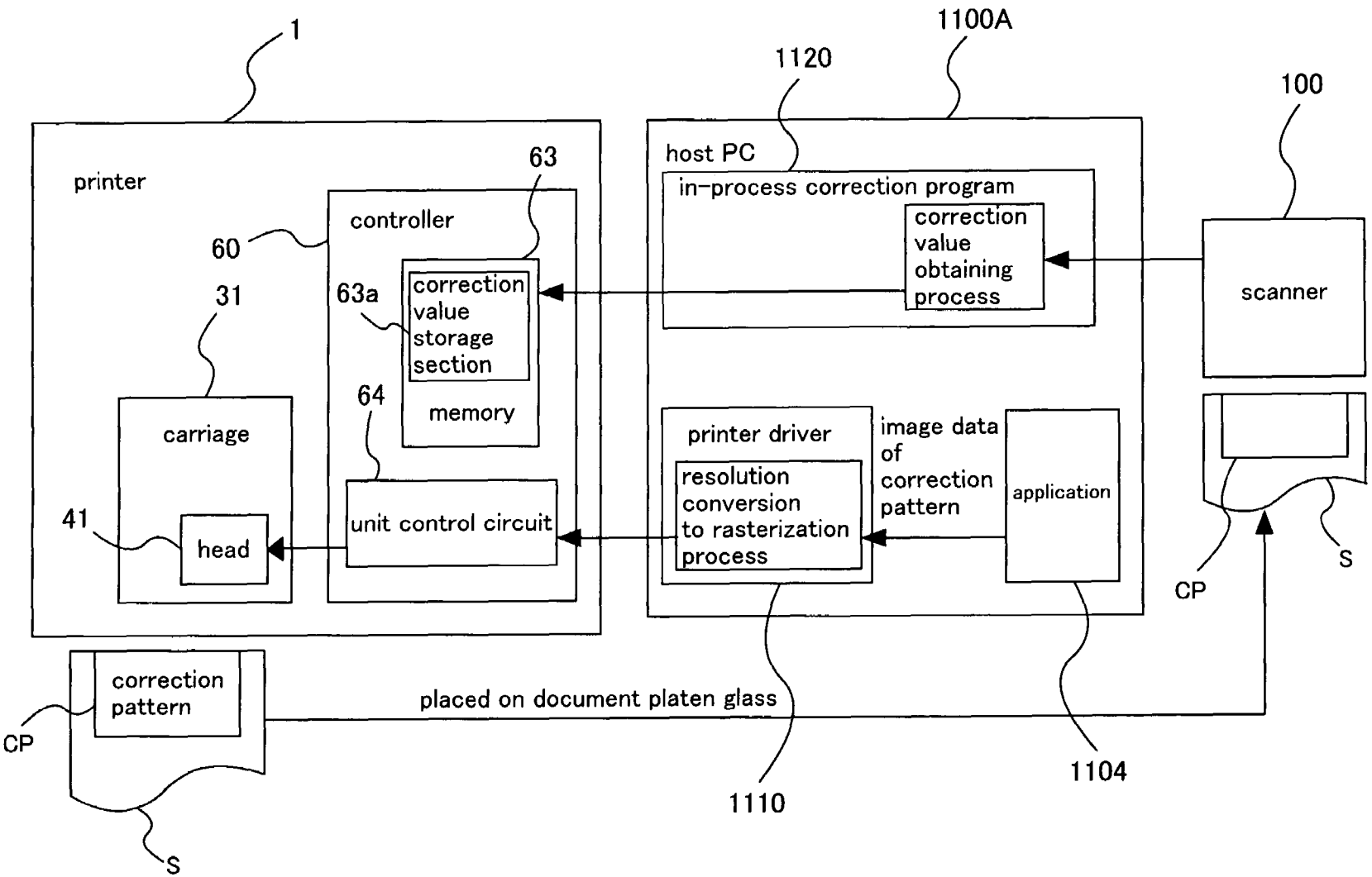
FIG. 20 is a block diagram illustrating devices used in setting the correction values.

Step S120: Setting the Darkness Correction Values for Inhibiting Darkness Non-Uniformities FIG. 20 is a block diagram illustrating the equipment used in setting the correction values. It should be noted that structural elements that have already been described are assigned identical reference numerals and thus further description thereof is omitted. In this diagram, a computer 1100A is a computer that is disposed on an inspection line, and runs an in-process correction program 1120. The in-process correction program 1120 can perform a correction value obtaining process. With this correction value obtaining process, a correction value for a target raster line is obtained based on a data group (for example, 256 tone grayscale data of a predetermined resolution) obtained by a scanner device 100 reading a correction pattern CP (see FIG. 25) that has been printed on a paper S. It should be noted that the correction value obtaining process is described in greater detail later. Also, an application program 1104 run by the computer 1100A outputs, to the printer driver 1110, image data for printing the correction pattern CP. Then, the printer driver 1110 performs the series of processes from resolution conversion to rasterization, and outputs to the printer 1 the print data for printing the correction pattern CP.

Figure 21:
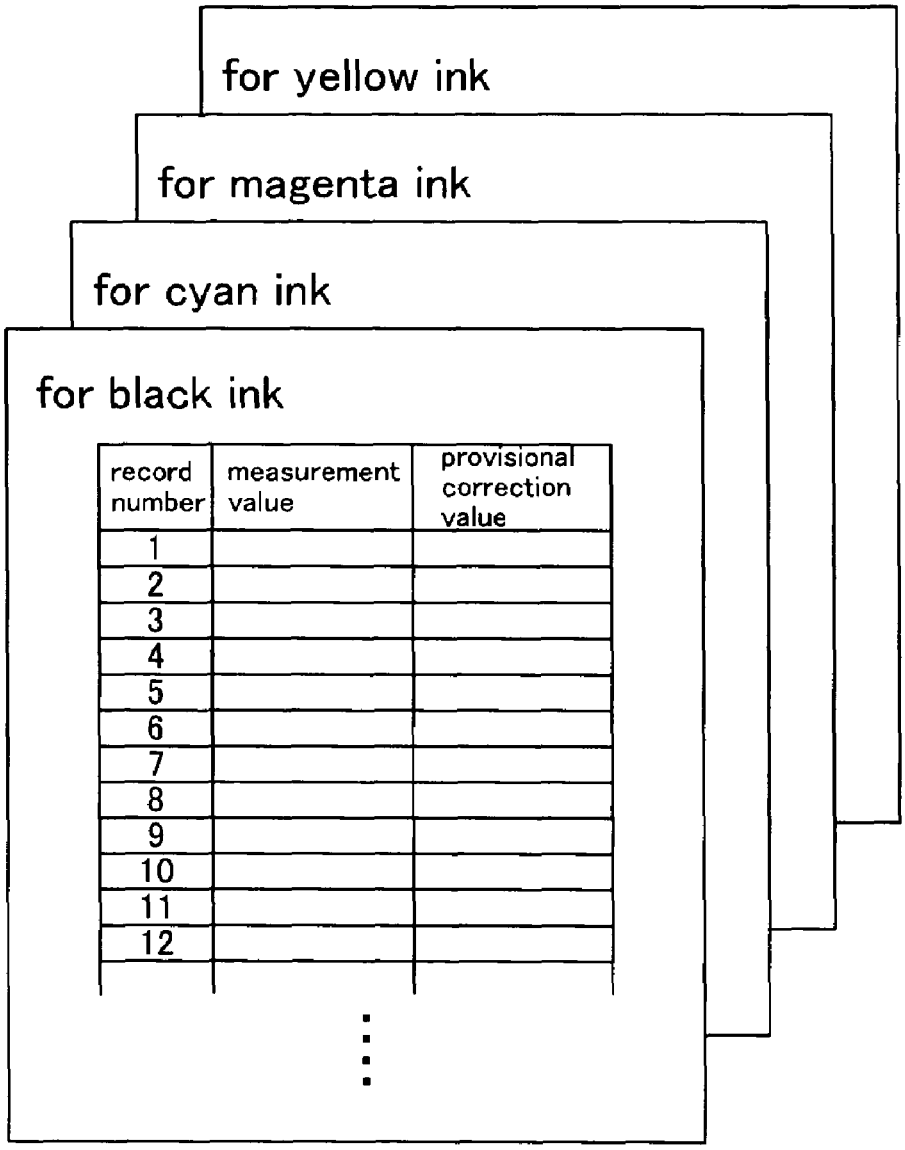
FIG. 21 is a conceptual diagram of a recording table that is provided in the memory of a computer.

FIG. 21 is a conceptual diagram of a recording table that is provided in the memory of the computer 1100. A recording table is prepared for each ink color. The measurement values of the correction pattern CP printed for each color are recorded in the corresponding recording table. It should be noted that this diagram shows the fields in the recording table for black (K) as a representative recording table.

A plurality of records are prepared in each recording table. These records are provided in correspondence with the raster lines. In other words, the number of records that is provided is a number with which the overall length of the print region can be processed. It should be noted that "print region" here means the region on which an image or the like is printed. For example, in the case of so-called four-side borderless printing, the entire surface of the paper S is the print region. On the other hand, in the case of so-called bordered printing, the region surrounded by the margins within the paper S is the print region. Furthermore, the "overall length of the print region" means the length in the carrying direction. A record number is assigned to each record.

A measurement value of the darkness of the raster line and a provisional correction value obtained based on the measurement value of the respective raster line is recorded in order in the recording table. Accordingly, two fields, a darkness measurement value field and a provisional correction value field, are prepared in each recording table. In the present embodiment, the measurement value and a provisional correction value th of a same raster line are both recorded in a record having the same record number. Specifically, these are recorded in order from records of low numbers starting from the raster line formed at the upper edge of the paper. For example, the darkness measurement value and the provisional correction value of the raster line formed in first place at the upper edge of the paper are recorded in the first record. Likewise, the darkness measurement value and the provisional correction value th of the raster line formed in second place at the upper edge of the paper are recorded in the second record. Then, the darkness measurement value and provisional correction value of other raster lines are recorded in the respective corresponding records.

Figure 22:
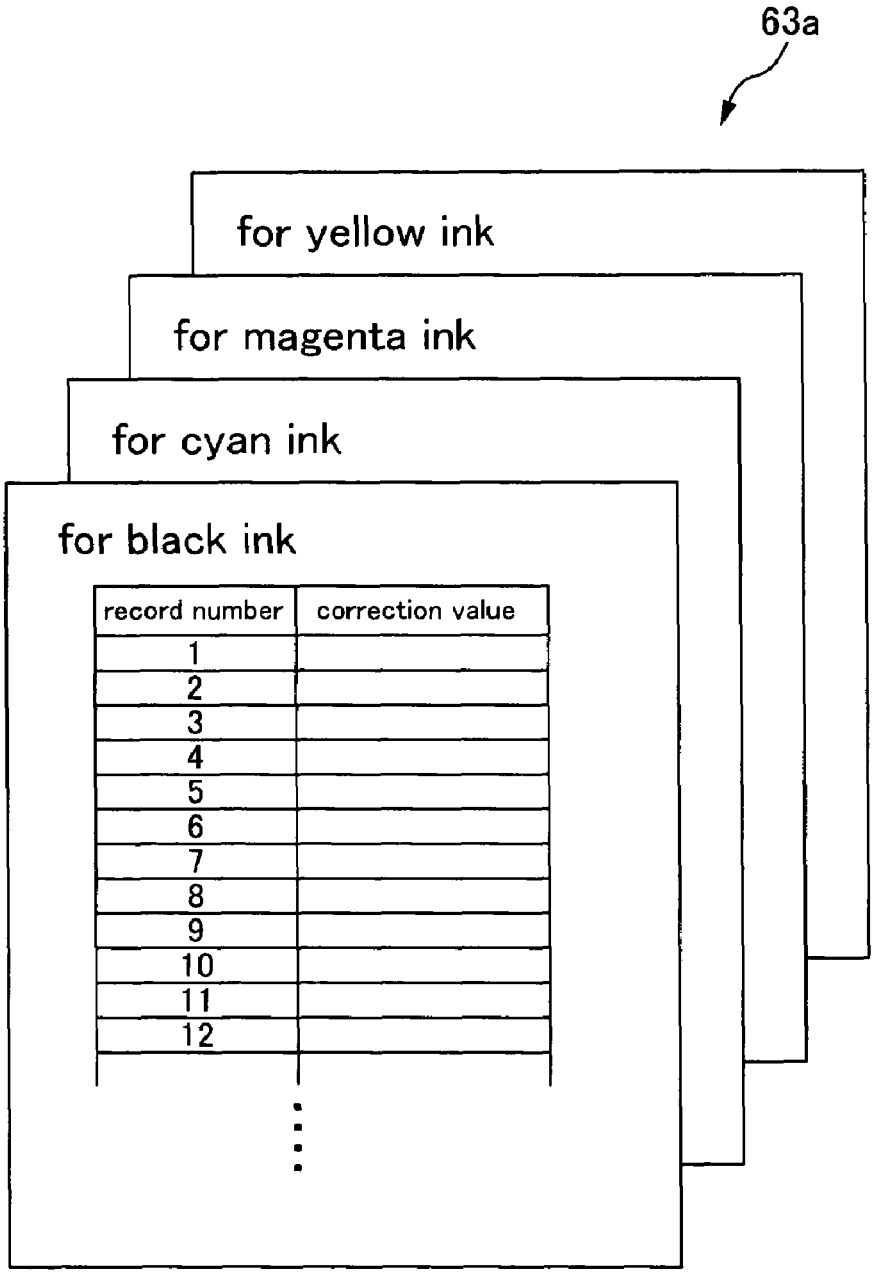
FIG. 22 is a conceptual diagram of the correction value storage section provided in the printer.

FIG. 22 is a conceptual diagram of the correction value storage section 63*a* provided in the memory 63 of the printer 1. As shown in the drawing, correction value tables are prepared in the correction value storage section 63*a*. Similar to the recording tables mentioned above, the correction value tables are provided individually for each ink color. Consequently, correction values also are prepared for each ink color. Also, this diagram shows the fields in the correction value table for black as a representative correction value table. These correction value tables each have records for recording a correction value. A record number is assigned to each record and, as with the above-mentioned recording tables, the correction values obtained by the correction value obtaining process are recorded in records corresponding to the respective raster line. Further, the number of records in the correction value table is a number corresponding to the overall length of the print region. It should be noted that the procedure for storing correction values in the correction value storage section 63*a* is described in greater detail later.

Figure 23A:
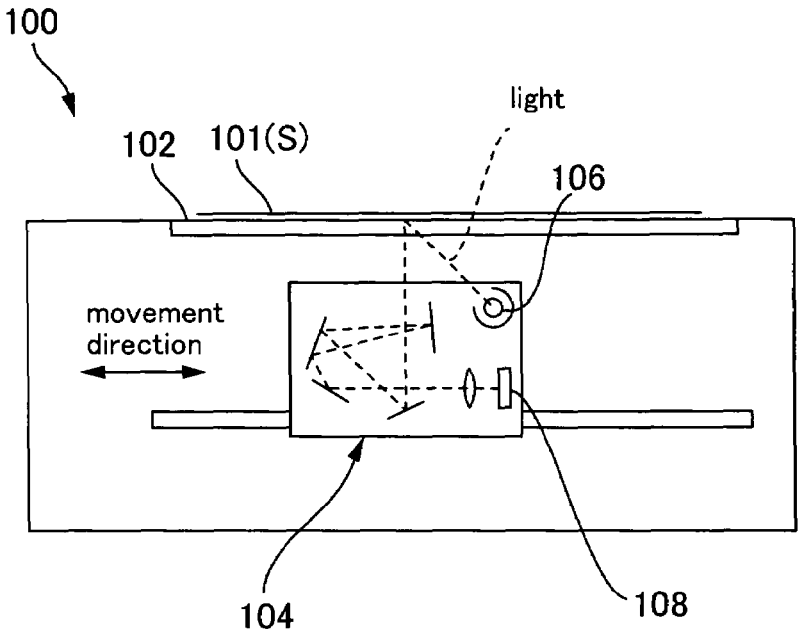
FIG. 23A is a vertical cross-sectional view of a scanner device.
Figure 23B:
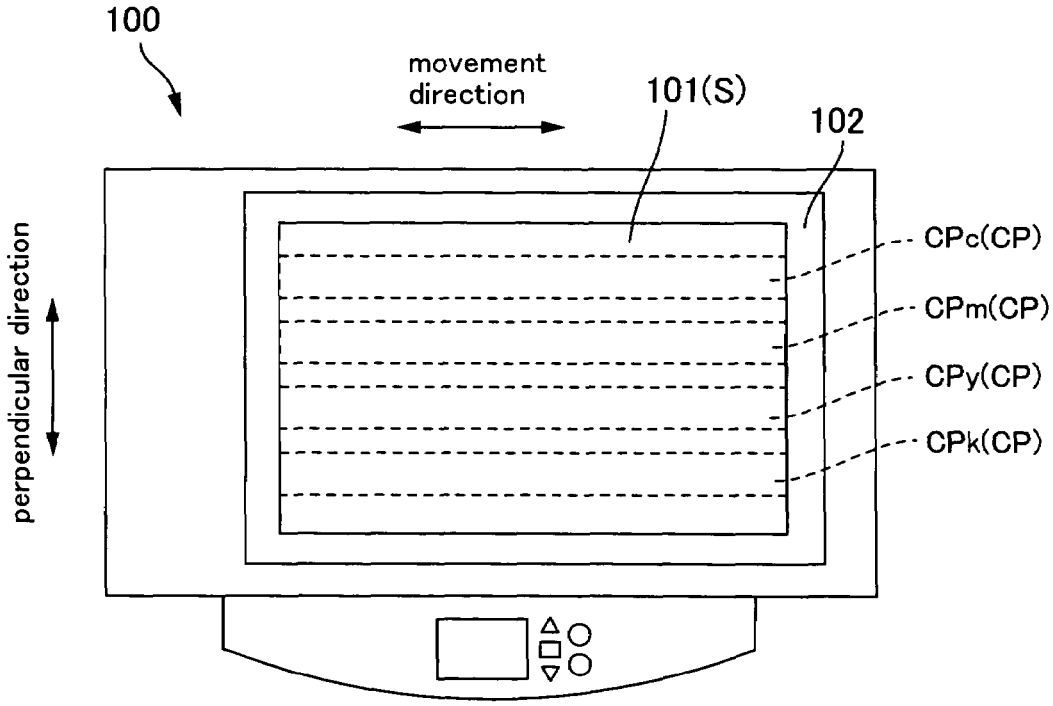
FIG. 23B is a plan view of a scanner device.

FIG. 23A is a diagram illustrating the scanner device 100 that is communicably connected to the computer 1100, and shows the scanner device 100 in profile. FIG. 23B is a plan view of the scanner device 100. The scanner device 100 is a darkness measuring device that measures the darkness of the correction patterns CP. The scanner device 100 is capable of reading, as a data group of pixel units, an image (for example, the correction pattern CP) that is printed on a document 101 (for example, the paper S). The scanner device 100 is provided with a document platen glass 102 on which the document 101 is placed, a reading carriage 104 that moves in a predetermined movement direction in opposition to the document 101 via the document platen glass 102, and a controller (not shown) for controlling the various sections, such as the reading carriage 104. The reading carriage 104 is provided with an exposure lamp 106 that irradiates light onto the document 101 and a linear sensor 108 for receiving the light that is reflected by the document 101 over a predetermined range in a perpendicular direction that is perpendicular to the movement direction. Then, when reading the document 101, the scanner device 100 moves the reading carriage 104 in the movement direction while causing an exposure lamp 106 to emit light and receives the light that is reflected with the linear sensor 108. In this way, the scanner device 100 reads the image printed on the document 101 at a predetermined reading resolution. It should be noted that the dashed lines in FIG. 23A indicate the path of the light during image reading.

Figure 24:
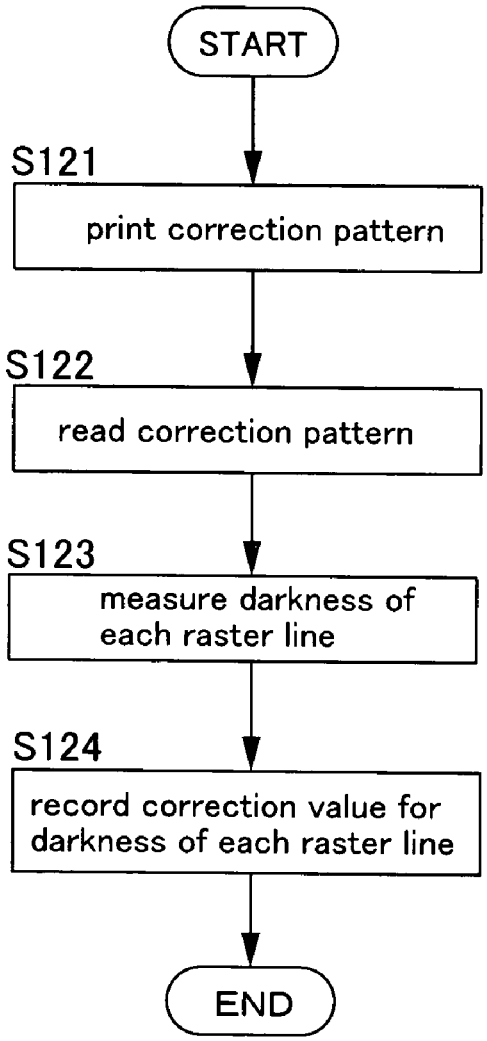
FIG. 24 is a flowchart showing the procedure of Step S120 in FIG. 19.

FIG. 24 is a flowchart showing the procedure of Step S120 in FIG. 19. The procedure for setting the correction values is described below using this flowchart.

This setting procedure includes a step of printing a correction pattern CP (S121), a step of reading the correction pattern CP (S122), a step of measuring the darkness of each raster line (S123), and a step of setting a darkness correction value for each raster line (S124). These steps are described in detail below.

(1) Printing the Correction Pattern CP (S121)

First, in Step S121, a correction pattern CP is printed on the paper S. Here, a worker on the inspection line communicably connects the printer 1 to a computer 1100A on the inspection line. The correction pattern CP is printed using the printer 1. In other words, the worker issues a command to print the correction pattern CP through a user interface of the computer 1100A. At that time, settings such as the print mode and the paper size mode are made through the user interface. Due to this command, the computer 1100A reads the image data of the correction pattern CP that is stored in the memory and performs the above-mentioned processes of resolution conversion, color conversion, halftoning, and rasterization. The result of this processing is that print data for printing the correction pattern CP is output to the printer 1 from the computer 1100A. Then, the printer 1 prints the correction pattern CP on the paper S according to the print data. It should be noted that the printer 1 that prints the correction pattern CP is the printer for which correction values are to be set. In other words, correction values are set for each printer.

Figure 25:
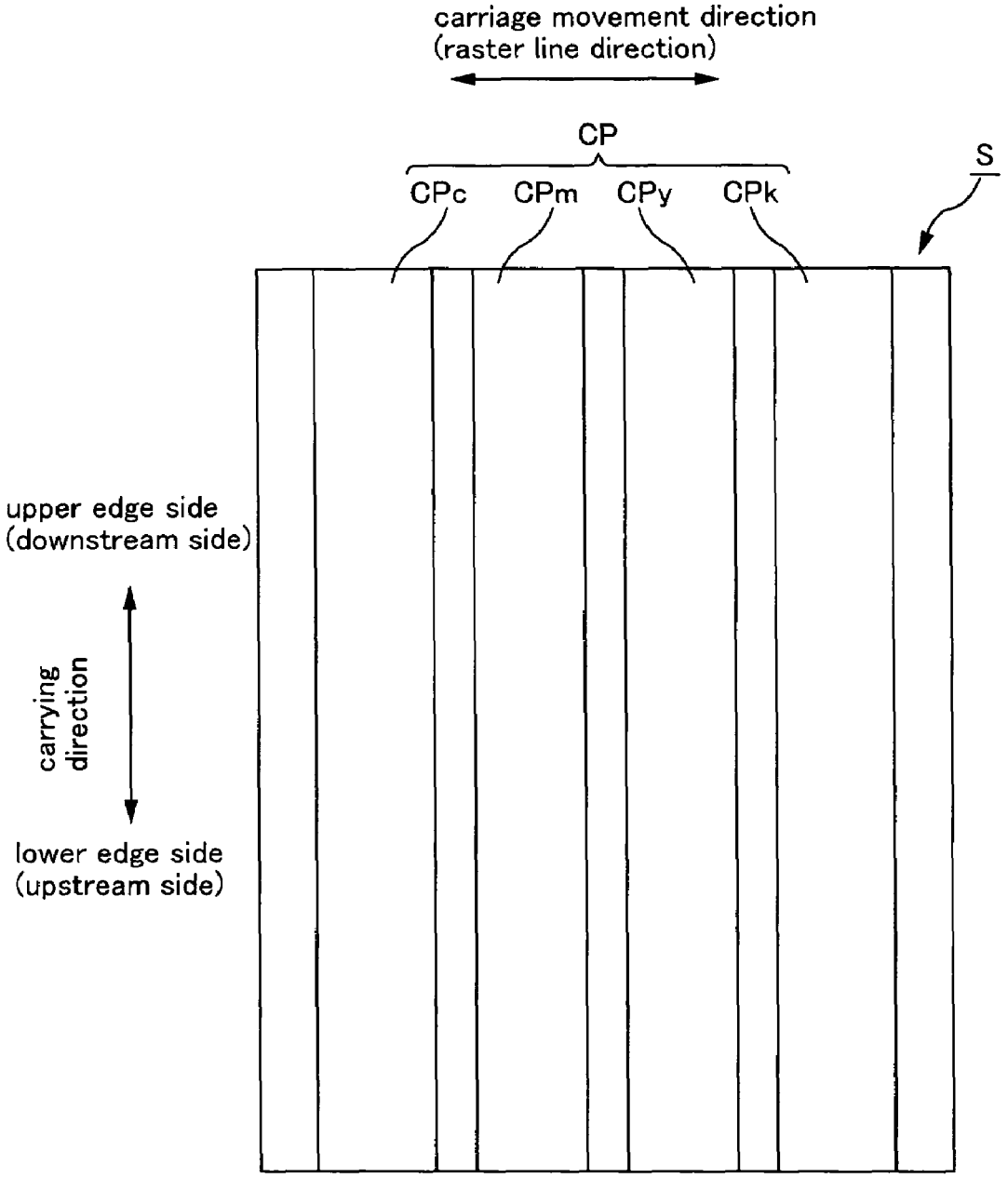
FIG. 25 is a diagram illustrating an example of the correction pattern that is printed.

Here, FIG. 25 is a diagram illustrating an example of the correction pattern CP that is printed. As shown in the drawing, the correction pattern CP of the present embodiment is a pattern of band shapes printed in segments for each ink color. The correction pattern CP shown here as an example has long thin band shapes in the carrying direction and is printed across the entire area of the paper S in carrying direction. In other words, it is formed contiguously from the upper edge to the lower edge of the paper S. Furthermore, a cyan (C) correction pattern CPc, a magenta (M) correction pattern CPm, a yellow (Y) correction pattern CPy, and a black (K) correction pattern CPk are printed lined up in the carriage movement direction in order from the left side in the diagram.

The print data of the correction patterns CP is data that has been created by performing halftoning and rasterization with respect to CMYK image data made by directly specifying the gradation values of each of the ink colors CMYK. The gradation values of the pixel data of this CMYK image data are set to the same value for all of the pixels of each correction pattern CP. Due to this, each correction pattern CP is printed at substantially the same darkness over the entire region in the carrying direction. The gradation values of these correction patterns CP can be changed freely. However, from the standpoint of actively inhibiting darkness non-uniformities in ranges susceptible to occurrences of darkness non-uniformities, a gradation value that results in an intermediate gradation is selected in the present embodiment. For example, in the case of black ink with gradation values of 256 levels, the range from gradation value 77 to gradation value 128 is selected.

In principle, the only difference between the correction patterns CP is the ink color. Also, as mentioned above, darkness non-uniformities in multicolor prints are inhibited for each ink color that is used in that multicolor print, but the method that is used for inhibiting the darkness non-uniformities is the same. For this reason, black (K) shall serve as an example in the following description. In other words, in the following description there are sections in which the description concerns only the color black (K), but the same also applies for the other ink colors C, M, and Y as well.

(2) Reading the Correction Patterns CP (Step S122)

Next, the correction patterns CP that have been printed are read by the scanner device 100. In Step S122, first a worker on the inspection line places the paper S on which the correction patterns CP have been printed onto the document platen glass 102. At this time, the worker places the paper S such that, as shown in FIG. 23B, the raster line direction of the correction patterns CP (CPc to CPk) and the perpendicular direction in the scanner device 100 (that is, the direction in which the linear sensor 108 is arranged) are the same direction. Once the paper S has been placed, the worker sets the reading conditions through the user interface of the computer 1100A and then issues a command to initiate reading. Here, it is preferable that the reading resolution in the movement direction of the reading carriage 104 is several integer multiples finer than the pitch of the raster lines. A reason for this is that the measured values of the darkness that are read and the raster lines can be correlated easily, allowing the measurement accuracy to be increased. When the command to initiate reading is received, the controller (not shown) of the scanner device 100 controls the reading carriage 104, for example, to read the correction patterns CP that have been printed on the paper S and obtain data groups in pixel units. Then, the obtained data groups are transferred to a memory (not shown) of the computer 1100A.

(3) Measuring the Darkness of the Correction Patterns (Step S123)

Next, the computer 1100A measures the darkness of the correction pattern CP raster line by raster line. These darkness measurements are carried out based on the obtained data groups. First, the computer 1100A recognizes, from the data groups transferred from the scanner device 100, the data pertaining to the raster line whose darkness is to be measured. Next, the computer 1100A measures the darkness of the raster line based on the recognized data. Here, it is preferable that the darkness measurement value of the raster line is an average value of the darkness of a plurality of pixels belonging to the same raster line. This is due to the correction patterns CP being printed in halftones. That is, since the correction patterns CP are printed at an intermediate gradation, even dots belonging to the same raster line will vary in size or be formed such that neighboring dots are decimated. For this reason, if a single pixel is used as a representative of that entire raster line, there is a possibility that the darkness of that raster line will vary depending on the pixel that undergoes darkness measurements, that is, depending on the position in the main-scanning direction. For this reason, in the present embodiment, the computer 1100A obtains the respective darkness of between several tens and several hundreds of pixels belonging to the same raster line, and the average value of the obtained darkness values is used as the darkness measurement value of that raster line.

Once a darkness measurement value of the raster line is obtained, the computer 1100A records the obtained measurement value in a record of the corresponding recording table. For example, if a measurement value of the first raster line (the raster line at the uppermost edge of the paper) in the carrying direction is obtained, then the measurement value is recorded in the first record. Once the obtained darkness is recorded, the computer 1100A obtains a measurement value for the next raster line using the same procedure, and records this in a record. Then, once measurement values have been obtained and records have been recorded until the final raster line, the process of measuring the darkness of the correction patterns CP is ended.

(4) Setting the Darkness Correction Value for Each Raster Line (Step S124)

Next, the computer 1100A sets a darkness correction value for each raster line. Here, the computer 1100A sets the darkness correction values based on the measurement values that have been recorded in the records of the recording tables, and stores these correction values in the correction value storage section 63*a* of the printer 1 (see FIG. 22).

In the present embodiment, the correction value for a given raster line is based on the darkness of a plurality of raster lines including the given raster line, of among the raster line group that constitutes the correction pattern CP printed on the paper. Specifically, when setting the correction value for a particular raster line, the darkness of a plurality of (that is, N) raster lines including that raster line is used. Here, it is preferable that the darkness of the plurality of raster lines are the darkness of the raster line for which the correction value is to be set, and the darkness of raster lines adjacent to that raster line in the carrying direction. By doing this, the correction value of a particular raster line is set taking into account the darkness of nearby raster lines, specifically, the darkness of raster lines selected in order of closeness to that raster line. In this way, it is possible to set appropriate correction values in accordance with actual printing, and the quality of printed images can be further improved.

Furthermore, the correction values in the present embodiment are set using provisional correction values each based on the darkness of each raster line. Here, the "provisional correction value" is a value for normalizing the darkness of a particular raster line and is equivalent to the correction value of the reference example. In other words, it can be said that the provisional correction values are used to change ordinary gradation values, which are set without any consideration to the characteristics of each nozzle (such as variations in the ejection amounts and the ink travel curves), into gradation values in which consideration is given to the characteristics of each nozzle.

In the provisional correction values of the present embodiment, correction ratios are used that indicate a coefficient with respect to the multi-level darkness gradation values (256 levels in the present embodiment), that is, the proportion to be corrected with respect to the darkness gradation values. For example, when the darkness of a raster line formed by an ordinary gradation value is lighter than the darkness corresponding to the gradation value, a value larger than "1.0" is set as the provisional correction value. Conversely, when the darkness of a raster line formed by an ordinary gradation value is darker than the darkness corresponding to that gradation value, a value smaller than "1.0" is set as the provisional correction value.

In the present embodiment, two to four raster lines are used in obtaining the correction values. This is a result of taking into account the graininess of the image to be printed and the effect of correction. This will be described in detail later, but in the present embodiment, in setting the correction value for a particular raster line, use is made of an average value of the provisional correction values for a plurality of raster lines. Here, in order to give consideration to graininess, it is appropriate to increase the number of raster lines, that is, the number of provisional correction values to be averaged. This is because this reduces the influence on the correction values by the provisional correction values of the raster lines for which correction values are to be set, thus enabling smoothing. However, from the viewpoint of accurately correcting the darkness of the raster lines, it is better that a smaller number of provisional correction values is averaged. In consideration of these points, in the present embodiment, the number of raster lines used to obtain provisional correction values is set as two to four lines so as to maintain good graininess while being able to carry out the necessary darkness corrections.

Figure 26:
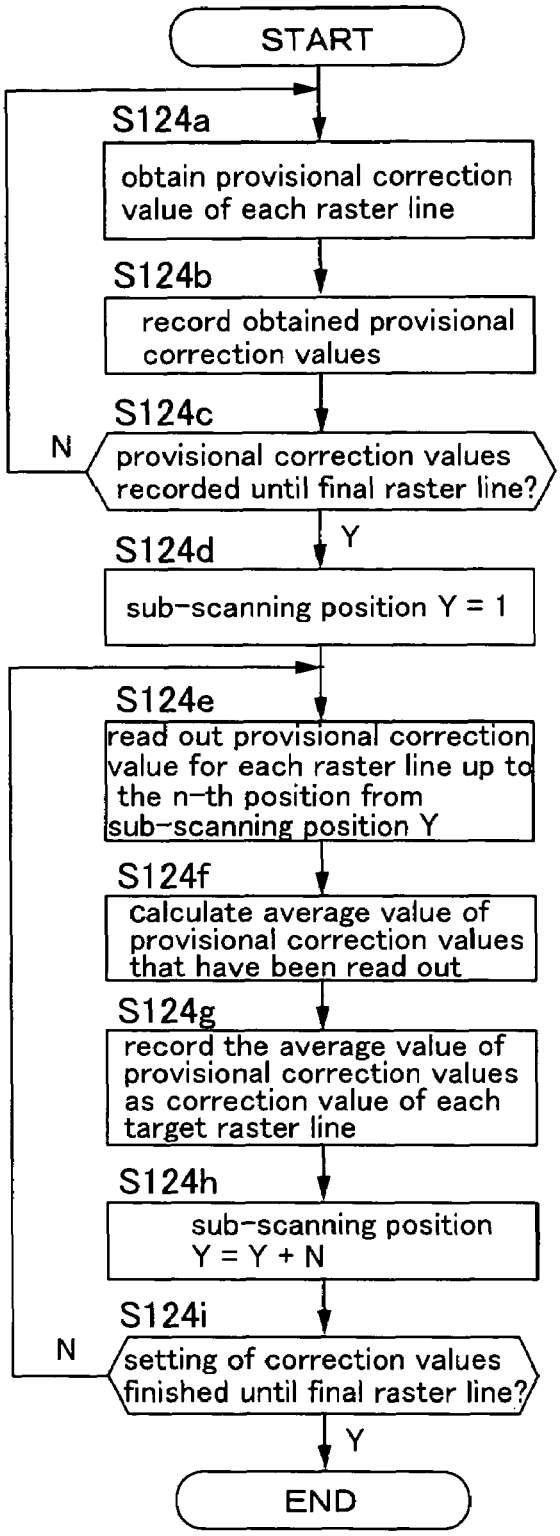
FIG. 26 is a flowchart illustrating the processes involved in setting the darkness correction values.

Setting the darkness correction value for each raster line is described in greater detail below. FIG. 26 is a flowchart illustrating the processes involved in setting the darkness correction values. It should be noted that, for the sake of convenience in the description below, the raster line formed at the uppermost edge of the paper (the first raster line) is sometimes expressed as sub-scanning position Y=1. Here, increment in the value of the sub-scanning position Y refers to a raster line formed toward a lower edge side of the paper.

First, in Step S124*a,* the computer 1100A obtains the provisional correction value of a given raster line. In the present embodiment, provisional correction values are obtained in order from the raster line at the upper edge of the paper. Accordingly, the computer 1100A first obtains the provisional correction value for the raster line in the sub-scanning position Y=1. This provisional correction value is obtained based on the darkness measurement value of that raster line. First, the computer 1100A calculates the average value of darkness measurement values stored in the recording tables. That is, the computer 1100A reads out and adds all the darkness measurement values recorded in the records pertaining to the same ink color and divides the sum by the number of records. Then, the calculated average value is set as the target value of darkness for that ink color. Next, the computer 1100A reads out the record corresponding to the darkness measurement value of that raster line (the first raster line for example), and divides the target value by the darkness measurement value that is read out. This quotient is then set as the provisional correction value for that raster line.

Expressing the provisional correction value as a numerical expression gives the following formula 1.

$$\text{provisional correction value } th = \text{target value } M/\text{darkness measurement value } C \quad \text{(Formula 1)}$$

For example, suppose that the darkness measurement value C of the raster line is 110 and the target value M is 100. In this case, the provisional correction value th of this raster line is obtained by 100/110, thus giving 0.9. Conversely, suppose that the darkness measurement value C of the raster line is 90 and the target value M is 100. In this case, the provisional correction value th of this raster line is obtained by 100/90, thus giving 1.1.

Next, in Step S124*b,* the computer 1100A records the obtained provisional correction value in the corresponding record of the recording table. For example, once the provisional correction value of the raster line of the sub-scanning position Y=1 is obtained, the computer 1100A records the provisional correction value in the first record of the provisional correction value field. Once the obtained provisional correction value is recorded, the procedure proceeds to Step S124*c,* and the computer 1100A determines whether or not provisional correction values have been recorded for all the raster lines until the final raster line. When there is a raster line for which recording is yet to be carried out remaining here, the computer 1100A obtains the provisional correction value for that raster line in Step S124*a,* and stores the obtained provisional correction value in the corresponding record in Step S124*b.* For example, in this case, the computer 1100A increments (adds one to) the value of the sub-scanning position Y and then carries out the process of Step S124*a* and the process of Step S124*b.* On the other hand, once the provisional correction values for all the raster lines have been set, the procedure proceeds to Step S124*d.*

Figure 27:
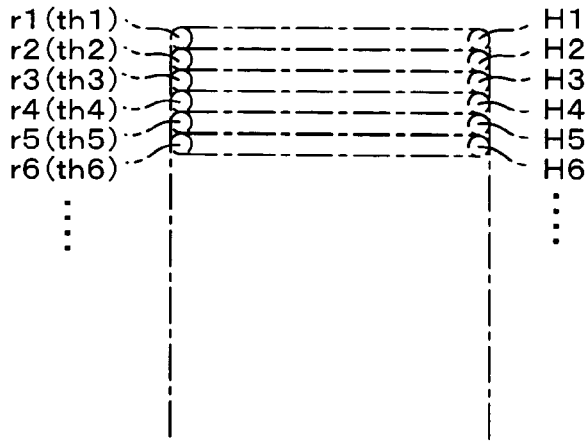
FIG. 27 is a diagram illustrating a relationship of the raster lines in the correction pattern, the provisional correction values, and the correction values.

From Step S124*d* through to Step S124*i,* which is described below, the correction values are set for each raster line. In this example, a common correction value is given to two (that is, N=2) raster lines adjacent in the carrying direction. The following description is given based on FIG. 27. FIG. 27 is a diagram illustrating a relationship of the raster lines in the correction pattern CP, the provisional correction values, and the correction values.

In Step S124*d,* the computer 1100A sets the sub-scanning position which is to be the reference. In this example, since the correction values are set in order from the upper edge of the paper, the computer 1100A first sets the first raster line r1 as the reference sub-scanning position. Specifically, a value of "1" is set as the sub-scanning position Y. Once the reference sub-scanning position is set, the procedure proceeds to Step S124*e,* and the required provisional correction value th is read out. In this case, the computer 1100A reads out the provisional correction value th of the raster line of the sub-scanning position Y and the provisional correction values th of the raster lines formed in the range of n positions (n=N−1) from the raster line of the sub-scanning position Y. As stated above, N=2 in this example, and therefore n=1. Accordingly, in this case, the computer 1100A reads out the provisional correction value th1 of the raster line r1 and the provisional correction value th2 of the raster line r2 that is formed adjacent to the raster line r1.

Once the provisional correction values th are read out, the procedure proceeds to Step S124*f.* In Step S124*f,* the computer 1100A calculates the average value of the provisional correction values th that have been read out. In the example here, the average value of the provisional correction value th1 of the first raster line r1 and the provisional correction value th2 of the second raster line r2 is calculated. Supposing that the provisional correction value th1 is 1.2 and the provisional correction value th2 is 0.9, then the average value is obtained as (1.2+0.9)/2, yielding 1.05.

Once the average value has been calculated, the procedure proceeds to Step S124*g.* In Step S124*g,* the computer 1100A sets the calculated average value as the correction value H of the raster lines in question, and records this value in the correction value storage section 63*a* of the printer 1. In the example here, the calculated average value becomes a correction value H1 of the first raster line r1 and a correction value H2 of the second raster line r2. Since the correction value H1 of the first raster line r1 and the correction value H2 of the second raster line r2 have been calculated here, the computer 1100A sends these correction values H1 and H2 to the printer 1 and records them in the first and second records of the correction value storage section 63*a*.

Once the correction values H have been recorded, the procedure proceeds to Step S124*h*. In Step S124*h*, the computer 1100A updates the reference sub-scanning position. Here, a value obtained by adding N, which is the number of raster lines for which the correction value H has been set, to the current sub-scanning position Y is set as a new sub-scanning position Y. That is, the computer 1100A carries out a calculation of Y=Y+N to obtain a new sub-scanning position Y. As illustrated in the example of FIG. 27, the current sub-scanning position Y has the value "1" and the number N of raster lines for which the correction value H has been set has the value "2," and therefore the new sub-scanning position Y has the value "3."

Once the reference sub-scanning position has been updated, the procedure proceeds to Step S124*i*. In Step S124*i*, the computer 1100A determines whether or not the correction value H has been set until the final raster line. This determination is carried out based, for example, on the sub-scanning position Y that is updated in Step S124*h*. That is, the computer 1100A can identify the raster line number corresponding to the final raster line based on such factors as the paper size and the print mode (bordered printing, borderless printing, roll paper printing in this case). Accordingly, the computer 1100A compares the updated sub-scanning position Y and the raster line number corresponding to the final raster line, and determines that the correction values H have been set until the final raster line based on the condition that the updated sub-scanning position Y has exceeded the raster line number corresponding to the final raster line. Then, when there are still raster lines remaining for which correction values H have not been set in step 124*i*, the procedure returns to Step S124*e* and the correction values H are set for those raster lines. On the other hand, once the correction value H has been set for the final raster line, the series of processes in which the correction values are set is ended.

To describe this using the example in FIG. 27, the new sub-scanning position Y has a value of "3," which is smaller than the raster line number corresponding to the final raster line. Thus, the computer 1100A determines that there is a raster line remaining for which the correction value H has not been set, and the procedure returns to Step S124*e* and the aforementioned processes are repeated. The following is a simple description of this. First, the computer 1100A reads out the provisional correction value th3 of the third raster line r3 and the provisional correction value th4 of the fourth raster line r4 (Step S124*e*), and then calculates the average value of the provisional correction values th3 and th4 (Step S124*f*). For example, if the provisional correction value th3 is 0.8 and the provisional correction value th4 is 1.1, then 0.95 is calculated as the average value. Next, the computer 1100A records the calculated average value as the correction values H3 and H4 of the raster lines r3 and r4 in the correction value storage section 63*a* of the printer 1 (Step S124*g*).

After this, the computer 1100A updates the sub-scanning position Y to the value "5" (Step S124*h*) and determines whether or not the correction values H have been set until the final raster line (Step S124*i*). In this determination too, the new sub-scanning position Y is determined to be smaller than the raster line number corresponding to the final raster line. For this reason, the procedure returns to Step S124*e*, and the correction values H5 and H6 of the raster lines r5 and r6 are set (Step S124*e* to Step S124*i*). For example, if the provisional correction value th5 is 1.1 and the provisional correction value th6 is 1.2, then 1.15 is obtained as the average value (of correction values H5 and H6).

After this, the same processes are performed, and when a new sub-scanning position Y exceeds the number corresponding to the final raster line, the series of processes is ended (Step S124*i*).

Figure 28:
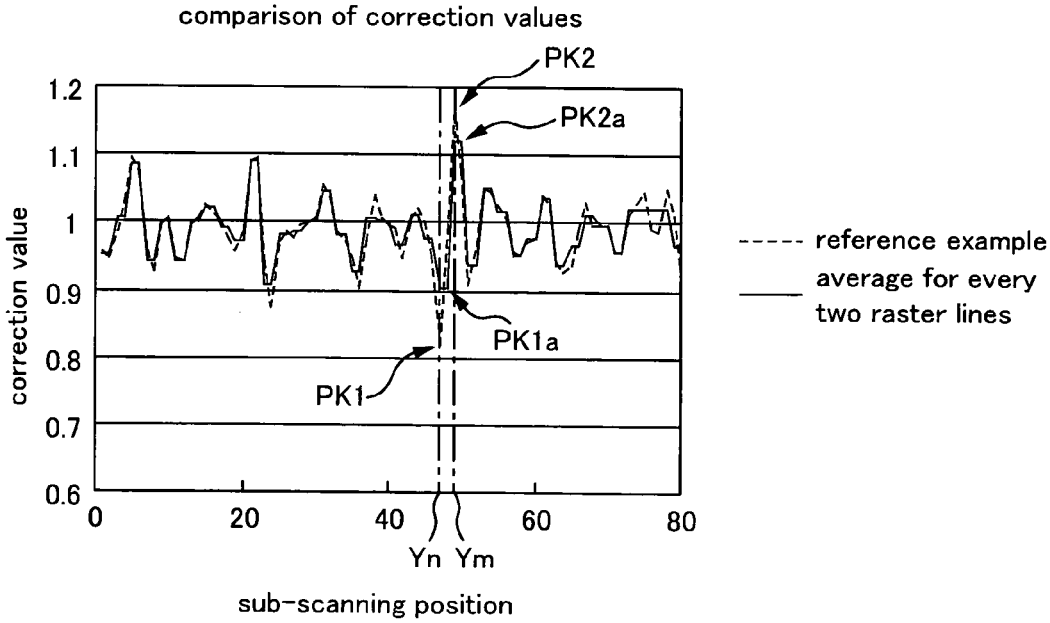
FIG. 28 is a diagram in which the correction values set by the method of the reference example and the correction values set by the method of the first embodiment are compared.

Compared to the method of the above-described reference example, it is possible with such a method of setting correction values to effect an evening out (smoothing) of the correction values in locations where the darkness difference between adjacent raster lines (that is, the difference in darkness from the intended darkness) is conspicuous. Here, FIG. 28 is a diagram comparing the correction values set by the method of the reference example with the correction values set by the method of the present embodiment. In this diagram, the vertical axis indicates the correction values and the horizontal axis indicates the sub-scanning position (raster line number). Furthermore, the dotted line in this diagram is for the correction values set by the method of the reference example and the solid line is for the correction values set by the method of the present embodiment.

In this diagram, the range indicated by the reference symbols from Yn to Ym is a range in which raster lines excessively darker and raster lines excessively lighter than the prescribed darkness are neighboring. That is, in the method of the reference example (dotted line) the peak (lower side peak) of the correction value shown by the reference symbol PK1 is the correction value of a raster line whose darkness is excessively dark, this value being approximately 0.82. Further, the peak (upper side peak) of the correction value shown by the reference symbol PK2 is the correction value of a raster line whose darkness is excessively light, this value being approximately 1.17. In this way, as mentioned before, when a raster line whose darkness is excessively dark and a raster line whose darkness is excessively light are side by side, the number of dots decimated for the raster line whose darkness is excessively dark becomes larger, and the number of dots added for the raster line whose darkness is excessively light becomes larger. As a result, graininess may be adversely affected. In regard to this point, since the average value of provisional correction values set for adjacent raster lines is used as the correction value for those raster lines in the method of the present embodiment, it is possible to set correction values of a moderate largeness.

For example, with the method of the present embodiment (solid line), the peak correction value corresponding to the peak of the reference symbol PK1 is reference symbol PK1*a*, this value being approximately 0.91. Similarly, the peak correction value corresponding to the peak of the reference symbol PK2 is reference symbol PK2*a*, this value being approximately 1.12. As will be described below, when carrying out actual printing using these correction values, for a raster line whose darkness is excessively dark, decimation of dots or the like will be carried out to make the darkness lighter, but the number of dots subjected to decimation or the like will be less than in the case of using the method of the reference example. Furthermore, for a raster line whose darkness is excessively light, adding of dots or the like will be carried out to make the darkness darker, but the number of dots to be added or the like will be less than in the case of using the method of the reference example. As a result, even though the required darkness correction is still carried out, it is possible to prevent graininess from being adversely affected. In addition, since the number of raster lines for which the provisional correction values that are averaged is from two to four raster lines, it is possible to sufficiently obtain the effect of darkness correction.

Further still, with the method of the present embodiment, shared correction values are set for a plurality of adjacent raster lines. For this reason, it is also possible to reduce the amount of correction value data. In this case, a configuration may be used in which a single record in the correction value storage section 63*a* is shared by a plurality of raster lines. In the example of FIG. 27, the first raster line r1 and the second raster line r2 can share the correction value H1, and the third raster line r3 and the fourth raster line r4 can share the correction value H3. For this reason, a configuration may be used in which the correction value H1 of the first raster line r1 and the second raster line r2 is recorded in the first record, and the correction value H3 of the third raster line r3 and the fourth raster line r4 is recorded in the second record.

Step S140: Actual Printing of the Image While Performing Darkness Correction for Each Raster Line The shipped printer 1 in which the darkness correction values are set is operated by a user. In other words, the actual printing is performed by the user. In the actual printing, the printer driver 1110 and the printer 1 work in cooperation to perform darkness correction for each raster line and execute printing in which darkness non-uniformities is inhibited. Here, the printer driver 1110 references the correction values stored in the correction value storage section 63*a* and corrects the pixel data such that it becomes a darkness corrected based on this correction value. That is, the printer driver 1110 changes the pixel data of the multiple gradations in accordance with the correction value when converting the RGB image data into print data. It then outputs the print data based on the corrected image data to the printer 1. The printer 1 forms the dots of the corresponding raster lines based on this print data. The print procedure is described in greater detail below.

Figure 29:
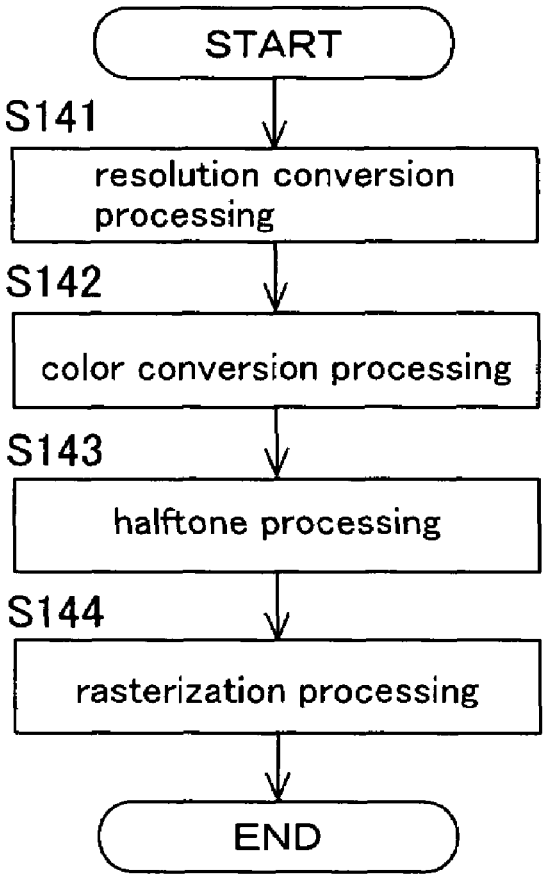
FIG. 29 is a flowchart showing the procedure of Step S140 in FIG. 19 for correcting the darkness of each raster line.

FIG. 29 is a flowchart showing the procedure for correcting the darkness of each raster line in Step S140 of FIG. 19. Hereinafter, the darkness correction procedure is described with reference to this flowchart. In the procedure, first, the printer driver 1110 carries out resolution conversion processing (Step S141). Next the printer driver 1110 successively performs color conversion (Step S142), halftoning (Step S143), and rasterization (Step S144). It should be noted that in these processes, the user communicably connects the printer 1 to the computer 1100, establishing the printing system 1000 described in FIG. 1.

Specifically, this is carried out on the condition that, once necessary information such as image quality mode and paper size mode has been input, an operation to execute printing is performed from the screen of the user interface of the printer driver 1110. The processes of these steps are described below.

Resolution Conversion Processing (Step S141): First, the printer driver 1110 performs resolution conversion on the RGB image data that has been output from the application program 1104. That is, it converts the resolution of the RGB image data to the print resolution corresponding to the image quality mode that has been input. Further still, the printer driver 1110 then suitably processes the RGB image data by trimming, for example, to adjust the number of pixels in the RGB image data so that it matches the number of dots in the print region corresponding to the paper size and margin format mode that have been designated.

Color Conversion Processing (Step S142): Next, the printer driver 1110 carries out color conversion, as described above, to convert the RGB image data into CMYK image data. As mentioned before, the CMYK image data includes C image data, M image data, Y image data, and K image data, and is set to an amount of data in accordance with the print region.

Halftone Processing (Step S143): Next, the printer driver 1110 performs halftoning. Halftoning is a process for converting the gradation values of 256 levels indicated by the pixel data in the C, M, Y, and K image data into gradation values of four levels that can be expressed by the printer 1. Then, in this embodiment, darkness correction is performed for each raster line during halftoning. In other words, the processing for converting the pixel data of the image data from a gradation value of 256 levels to one of four levels is performed while correcting the pixel data by the amount of the correction value. Darkness correction is performed for each of the C, M, Y, and K image data based on the correction value table for each ink color, but here black (K) image data are described as representative image data.

In the present embodiment, the gradation values of the 256 levels are first substituted with level data and then converted into gradation values of four levels in this halftone process. Accordingly, at the time of this conversion, the 256 gradation values are changed by the amount of the correction value so as to correct the pixel data of gradation values having four levels, thus performing "correction of pixel data based on the correction value."

It should be noted that the halftoning here differs from the halftoning that has already been described using FIG. 3 in that it includes steps S301, S303, and S305 for setting the level data, but otherwise the two are identical. Consequently, the following description focuses on this difference, and description of aspects that are the same has been simplified. Also, the following description is made with reference to the flowchart of FIG. 3 and the dot creation ratio table of FIG. 4.

First, the printer driver 1110 obtains the K image data in Step S300, which is the same as in ordinary halftoning. Next, in Step S301, the printer driver 1110, for each pixel data, reads the level data LVL corresponding to the gradation value of that pixel data from the large dot profile LD of the creation ratio table. However, in the present embodiment, at the time of this reading, the gradation value is shifted by the amount of the correction value corresponding to the raster line to which the pixel data belongs and then the level data LVL is read.

For example, if the raster line to which that pixel data belongs is the first raster line, then that raster line corresponds to the correction value H of the first record. Then if the gradation value of that pixel data is gr, the level data LVL is read out in accordance to the new gradation value (gr×H) that is obtained by multiplying the correction value H by the gradation value gr. In this way, a level data value LVL of 11*d* is obtained.

This calculation process can be carried out easily and at high speed. Accordingly, processing can be simplified to enable high-frequency ejection of ink.

In Step S302, the printer driver 1110 determines whether or not the large dot level data LVL is greater than the threshold value THL of the pixel block corresponding to that pixel data on the dither matrix. The level data LVL has changed by the value Δgr based on the correction value H. Consequently, the result of this magnitude comparison changes in accordance with the amount of change, and thus the tendency at which the large dot is formed also changes. As a result, the "correction of pixel data based on the correction value" mentioned above is achieved. It should be noted that if in Step S302 the level data LVL is larger than the threshold value THL, then the procedure proceeds to Step S310 and a large dot is recorded corresponding to that pixel data. Otherwise the procedure advances to Step S303.

In Step S303, the printer driver 1110 reads the level data LVM corresponding to the gradation value from the medium dot profile MD of the creation ratio table, and at this time also, as in Step S301, the level data LVM is read while shifting the gradation value in accordance to the correction value H. As a result, a level data LVM of 12*d* is obtained. Next, in Step S304 the printer driver 1110 determines whether or not the medium dot level data LVM is greater than the threshold value THM of the pixel block corresponding to that pixel data on the dither matrix. Here also, the level data LVM has changed by an amount corresponding to the value Δgr. Accordingly, the result of this magnitude comparison changes in accordance with the amount of change, and thus the tendency at which the medium dot is formed also changes. It should be noted that if in Step S304 the level data LVM is larger than the threshold value THM, then the procedure proceeds to Step S309 and a medium dot is recorded corresponding to that pixel data. Otherwise the procedure advances to Step S305.

In Step S305, the printer driver 1110 reads the level data LVS corresponding to the gradation value from the small dot profile SD of the creation ratio table, and at this time also, as in Step S301, the level data LVS is read by shifting the gradation value in accordance to the correction value H. As a result, a level data LVS of 13*d* is obtained. Next, in Step S306 the printer driver 1110 determines whether or not the small dot level data LVS is greater than the threshold value THS of the pixel block corresponding to that pixel data on the dither matrix. Here also, the level data LVS has changed by an amount corresponding to the value Δgr. Accordingly, the result of this magnitude comparison changes in accordance with the amount of change, and thus the tendency at which the small dot is formed also changes.

It should be noted that if in Step S306 the level data LVS is larger than the threshold value THS, then the procedure advances to Step S308, and a small dot is recorded corresponding to that pixel data. Otherwise the procedure advances to Step S307 and no dot is recorded corresponding to that pixel data.

Rasterization Processing (Step S144): Next, the printer driver 1110 performs rasterization. The rasterized print data is output to the printer 1, and the printer 1 executes actual printing of the image to the paper S according to the pixel data of the print data. It should be noted that as discussed above, the darkness of the pixel data has been corrected for each raster line, and thus darkness non-uniformities can be effectively inhibited in the image that is printed.

That is, since each raster line is formed under a condition in which its gradation value is changed based on the correction value, a raster line that, without correction, would be formed darker than the prescribed darkness (designed darkness) is corrected so as to have a lower gradation value. As a result, such a raster line is formed in a state in which the amount of ink is suppressed and can be formed with a darkness closer to the desired darkness. Similarly, a raster line that would, without correction, be formed lighter than the prescribed darkness is corrected so as to have a larger gradation value and to increase the amount of ink, and therefore can be formed with a darkness closer to the desired darkness. Further still, in the present embodiment, in addition to the provisional correction value being set for each raster line based on the darkness of each raster line, the average value of the provisional correction values that have been set for a plurality of adjacent raster lines is used as the correction value for that raster line. In this way, it is possible to prevent a phenomenon such as dots being inordinately added to a raster line that is excessively lighter than its prescribed darkness, and it is possible to prevent a phenomenon such as dots being inordinately decimated from a raster line that is excessively darker than its prescribed darkness. As a result, even though the required darkness correction is still carried out, it is possible to prevent graininess from being adversely affected.

Second Embodiment

In the first embodiment, common correction values were set for a plurality of adjacent raster lines. Concerning this point, it is also possible to set correction values for a given raster line from the darkness of a plurality of raster lines. A second embodiment having such a configuration is described next. It should be noted that a main difference between the second embodiment and the above-described first embodiment is the process by which the correction values are set for each raster line (Step S124 in FIG. 24). Consequently, the following description focuses on this difference.

In the process by which correction values are set, the computer 1100A, which is installed on an inspection line, obtains the darkness correction value H based on the measured values that have been recorded in the records of the recording tables, and stores the correction values H in the correction value storage section 63*a* of the printer 1 (see FIG. 22). The correction values H in the second embodiment also are set based on the darkness of the raster lines. Specifically, the correction values H are set from the provisional correction values of a plurality (N lines: N=2 to 4) of raster lines including the raster line in question.

Figure 30:
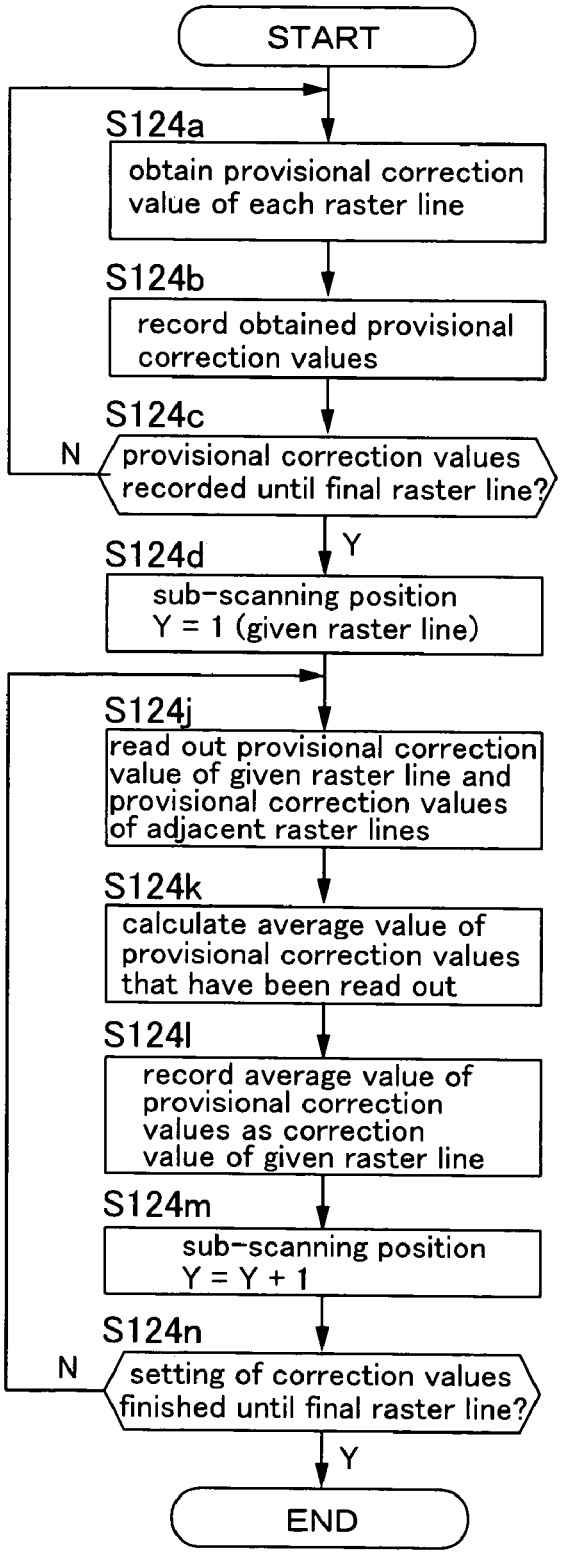
FIG. 30 is a flowchart describing a process for setting darkness correction values.

The way in which the darkness correction value for each raster line is set is described in greater detail below. Here, FIG. 30 is a flowchart illustrating the processes involved in setting the darkness correction values and corresponds to the flowchart shown in FIG. 26 for the first embodiment. For this reason, processes that are the same as those of the first embodiment are assigned identical reference numerals and description thereof is omitted.

First, in steps S124*a* to S124*c*, the computer 1100A obtains the provisional correction value for each raster line and records the obtained provisional correction value in a corresponding record of the recording table. These processes are the same as the processes in the first embodiment. That is, the computer 1100 sets the average value of darkness measurement values as target values. Then, the target value is divided by the darkness measurement value of that raster line to obtain the provisional correction value. Once the provisional correction values for all the raster lines have been set, the procedure proceeds to Step S124*d*.

In the processes of Step S124*d* and steps S124*j* to S124*n*, which are described below, a correction value H is set for each raster line. In this example, the correction value H of the given raster line is set in accordance with the provisional correction value of the given raster line and the provisional correction values of two raster lines that are adjacent to the given raster line on both sides thereof in the carrying direction. That is, the correction value H of the given raster line is set based on the provisional correction values of three consecutive raster lines with this raster line being sandwiched between. This setting process is described in greater detail below. The following description is given with reference to FIG. 27.

In Step S124*d,* the computer 1100A sets the reference sub-scanning position, that is, the given raster line for which the correction value H is to be set. In this example, since the correction values will be set in order from the upper edge of the paper, the computer 1100A first sets the first raster line r1 as the given raster line.

Once the given raster line is set, the procedure proceeds to Step S124*j,* and the required provisional correction value th is read out. In this process, the computer 1100A reads out the provisional correction value th of the given raster line and the provisional correction value th of the raster line formed one line above this raster line and the provisional correction value th of the raster line formed one line below. For example, if the given raster line is the second raster line r2, then the provisional correction value th1 of the first raster line r1 (one line above this raster line), the provisional correction value th2 of the second raster line r2 (the given raster line), and the provisional correction value th3 of the third raster line r3 (one line below this raster line) are read out.

It should be noted that when the given raster line is the first raster line r1, no raster line is present above the given raster line. In this case, the computer 1100 reads out the provisional correction value th of the given raster line and the provisional correction value th of the raster line that is formed one line below. Similarly, when the given raster line is the final raster line, the provisional correction value th of the given raster line and the provisional correction value th of the raster line that is formed one line above are read out.

Once the provisional correction values th are read out, the procedure proceeds to Step S124*k.* In Step S124*k,* the computer 1100A calculates the average value of the provisional correction values th that have been read out. In this process, usually, the average value of the provisional correction value th of the given raster line, the provisional correction value th of the raster line formed one line above this raster line and the provisional correction value th of the raster line formed one line below this raster line is calculated. When the given raster line is the second raster line r2, the average value of the provisional correction values th1 to th3 corresponding to the first raster line r1, the second raster line r2, and the third raster line r3 is calculated.

In this process also, when the given raster line is the first raster line r1, the average value of the provisional correction value th1 of the first raster line r1 and the provisional correction value th2 of the second raster line r2 is obtained. Similarly, when the given raster line is the final raster line, the average value of the provisional correction value th of the given raster line and the provisional correction value th of the raster line that is formed one line above is calculated.

Once the average value has been calculated, the procedure proceeds to Step S124*l.* In Step S124*l,* the computer 1100A sets the calculated average value as the correction value H of the given raster line. For example, when the given raster line is the first raster line r1, the calculated average value becomes the correction value H1 of the first raster line r1. Similarly, when the given raster line is the second raster line r2, the calculated average value becomes the correction value H2 of the second raster line r2. The computer 1100A stores the calculated correction values H in the correction value storage section 63*a* of the printer 1. For example, once the correction value H1 of the first raster line r1 has been calculated, the computer 1100A sends the correction value H1 to the printer 1 and records it in the first record of the correction value storage section 63*a.*

Once the correction value has been recorded, the procedure proceeds to Step S124*m.* In Step S124*m,* the computer 1100A updates the reference sub-scanning position (the given raster line). In the present embodiment, as mentioned above, the correction values H are set for each raster line in order from the upper edge of the paper, and therefore the information about the new sub-scanning position Y is obtained by incrementing (updating with "+1") the current sub-scanning position Y.

Once the reference sub-scanning position has been updated, the procedure proceeds to Step S124*n.* In Step S124*n,* the computer 1100A determines whether or not the correction value H has been set until the final raster line. This determination is the same as in the first embodiment, and is carried out by comparing the updated sub-scanning position Y and the raster line number corresponding to the final raster line. For example, the computer 1100A determines that correction values have been set until the final raster line based on the condition that the updated sub-scanning position Y has exceeded the raster line number corresponding to the final raster line. Then, when there are still raster lines remaining for which correction values H have not been set in step 124*n,* the procedure returns to step 124*j* and the correction values H are set for those raster lines. On the other hand, once the correction value H has been set for the final raster line, the series of processes in which the correction values are set is ended.

Figure 31:
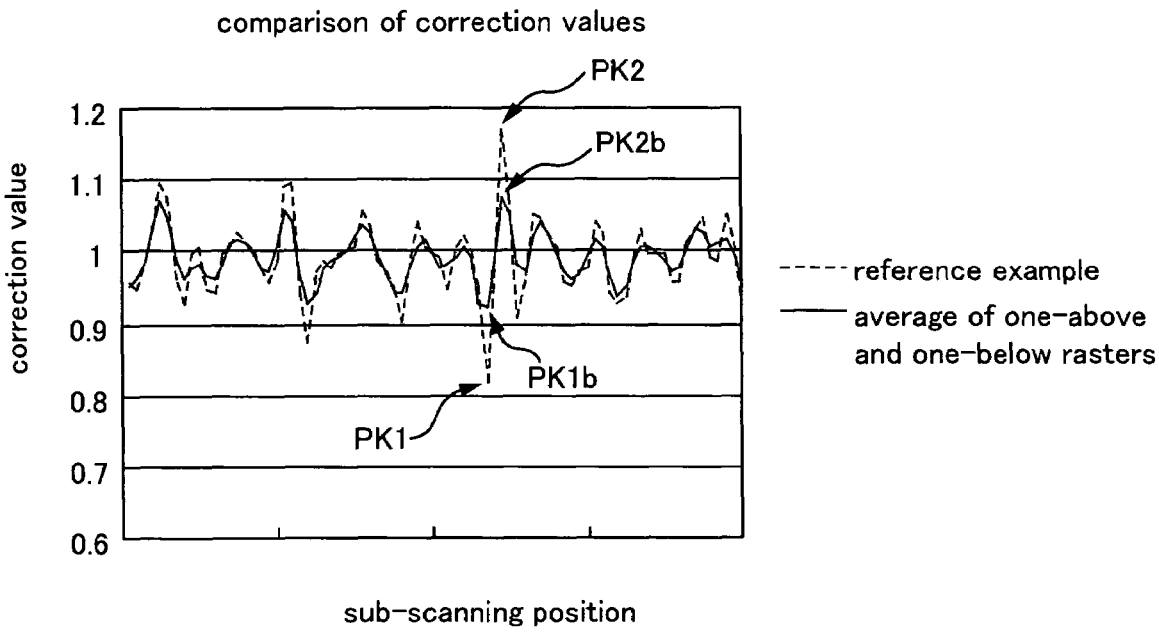
FIG. 31 is a diagram in which the correction values set by the method of the reference example and the correction values set by the method of the second embodiment are compared.

Compared to the method of the above-described reference example, it is possible with such a method of setting correction values to effect an evening out of the correction values in locations where the darkness difference between adjacent raster lines (that is, the difference in darkness from the prescribed darkness) is conspicuous. Here, FIG. 31 is a diagram in which the correction values set by the method of the reference example described earlier and the correction values set by the method of the present embodiment are compared. In this diagram, the vertical axis indicates the correction values and the horizontal axis indicates the raster line number. Furthermore, the dotted line in this diagram is for the correction values set by the method of the reference example and the solid line is for the correction values set by the method of the present embodiment.

As evident from this diagram, compared to the correction values that have been set using the method of the reference example, with the correction values that have been set by the method of the present embodiment, drastic variations in the correction values of adjacent raster lines are alleviated. In particular, the peaks PK1 and PK2 of the correction values in the reference example are turned into the peaks PK1*b* (approximately 1.08) and PK2*b* (approximately 0.92), respectively. As a result, it is evident that while the required darkness correction is still carried out, graininess is prevented from being adversely affected. And, as in the first embodiment, when carrying out actual printing using these correction values, the number of dots subjected to decimation in a raster line whose darkness is excessively dark becomes less than in the case of using the method of the reference example. Furthermore, for a raster line whose darkness is excessively light, the number of dots that are added becomes less than in the case of using the method of the reference example. As a result, while graininess is prevented from being adversely affected, the required corrections can be carried out.

Additionally, in the present embodiment, since the correction values are set individually for each raster line, it is possible to set the most suitable correction value for each raster line. As a result, it is possible to prevent graininess from being adversely affected and to carry out darkness corrections very appropriately.

In this regard, in the present embodiment, the correction value of the given raster line was obtained based on the provisional correction value corresponding to the given raster line and the provisional correction values of the raster lines that sandwich this raster line and that are adjacent thereto on both sides in the carrying direction; however, the present embodiment is not limited to this method. For example, it is also possible to obtain the correction value of the given raster line based on the provisional correction value corresponding to the given raster line and the provisional correction value/values of a raster line/raster lines that is/are adjacent on one side of the given raster line in the carrying direction.

Other Embodiments

The above-described first embodiment and second embodiment were described primarily with regard to the printer 1, but these embodiments also include the disclosure of a printing apparatus, a printing method, and a printing system 1000, for example. Furthermore, a printer 1, for example, was described as one embodiment, but the foregoing embodiments are for the purpose of elucidating the present invention and are not to be interpreted as limiting the present invention. The invention can of course be altered and improved without departing from the gist thereof and includes equivalents. In particular, the embodiments mentioned below are also included in the invention.

<Regarding the Correction Values>

In the foregoing embodiments, a method was described in which provisional correction values are set based on the darkness of the raster lines and the average value of the provisional correction value is used as the correction value of the raster lines; however, the present invention is not limited to this method. For example, a configuration is also possible in which, without using provisional correction values, a correction value of a raster line is obtained from the darkness of a plurality of raster lines.

<Regarding the Printer>

In the above embodiments, the printer 1 and the scanner device 100 are configured separately, and each is communicably connected to the computer 1100; however, there is no limitation to this configuration. For example, the present invention can also be applied to a so-called printer-scanner compound device that has both the function of the printer 1 and the function of the scanner device 100.

Also, a printer 1 was described in the above embodiments, but the present invention is not limited to this. For example, technology like that of the present embodiment can also be adopted for various types of recording apparatuses that use inkjet technology, including color filter manufacturing devices, dyeing devices, fine processing devices, semiconductor manufacturing devices, surface processing devices, three-dimensional shape forming machines, liquid vaporizing devices, organic EL manufacturing devices (particularly macromolecular EL manufacturing devices), display manufacturing devices, film formation devices, and DNA chip manufacturing devices. Also, methods therefor and manufacturing methods thereof are within the scope of application.

<Regarding the Ink>

The above embodiments were of the printer 1, and thus a dye ink or a pigment ink was ejected from the nozzles. However, the ink that is ejected from the nozzles is not limited to such inks.

<Regarding the Nozzles>

In the foregoing embodiments, ink was ejected using piezoelectric elements; however, the mode for ejecting ink is not limited to this. For example, other methods, such as a method for generating bubbles in the nozzles through heat, may also be employed.

<Regarding the Print Mode>

The interlaced mode was described as an example of the print mode in the above embodiments, but the print mode is not limited to this, and it is also possible to use the so-called overlapping mode. With interlacing, a single raster line is formed by a single nozzle, whereas with overlapping, a single raster line is formed by two or more nozzles. That is, with overlapping, each time the paper S is carried by a constant carry amount F in the carrying direction, the nozzles, which move in the carriage movement direction, intermittently eject ink droplets at intervals of every several pixels to intermittently form dots in the carriage movement direction. Then, in another pass, dots are formed by another nozzle such that the intermittent dots already formed are completed in a complementary manner, and thus a single raster line is completed by a plurality of nozzles.

<Regarding the Target of Darkness Correction>

In the above embodiments, darkness correction is performed based on correction values from the halftone processing, but the present invention is not limited to this method. For example, it is also possible to adopt a configuration in which darkness correction is performed based on correction values with respect to the RGB image data that is obtained through resolution conversion.

<Regarding the Carriage Movement Direction in which Ink is Ejected>

The foregoing embodiments described an example of single-direction printing in which ink is ejected only when the carriage 31 is moving forward, but this is not a limitation, and it is also possible to perform so-called bidirectional printing in which ink is ejected both when the carriage 31 is moving forward and backward.

<Regarding the Color Inks Used for Printing>

The foregoing embodiments described an example of multicolor printing in which the four color inks of cyan (C), magenta (M), yellow (Y), and black (K) are ejected onto the paper S to form dots, but the ink colors are not limited to these. For example, it is also possible to use other inks in addition to these, such as light cyan (pale cyan; LC) and light magenta (pale magenta; LM). Alternatively, it is also possible to perform single-color printing using only one of these four colors.

What is claimed is:

1. A printing method comprising:

(a) a step of printing a correction pattern on a medium, wherein said correction pattern:

is constituted by a line group including a plurality of lines arranged in an intersecting direction that intersects a movement direction of nozzles, each of said lines being made of a plurality of dots arranged in said movement direction, and is printed by alternately repeating an operation of ejecting ink from a plurality of said nozzles and an operation of moving said medium in said intersecting direction;

(b) a step of setting for each of said lines a correction value for correcting a darkness in said intersecting direction of an image to be printed on said medium, wherein each of said correction values is set based on a darkness of N lines that are adjacent to one another in said intersecting direction, in said line group, including the line whose correction value is to be set, and wherein said correction value is set to a value that is shared by said N lines; and (c) a step of printing said image on said medium based on said correction values that have been set for each of said lines.

2. A printing method according to claim 1, wherein in said step of printing said image on said medium based on said correction values that have been set for each of said lines, said lines are formed at a darkness corresponding to gradation values, and said gradation values of said image are changed based on said correction values.

3. A printing method according to claim 1, wherein in said step of printing said image on said medium based on said correction values that have been set for each of said lines, a line that is not formed is set between the lines that are formed by carrying out the operation of ejecting ink from said plurality of said nozzles once, and lines are formed in a complementary manner by carrying out the operation of ejecting ink from said plurality of said nozzles a plurality of times.

4. A printing method comprising:

(a) a step of printing a correction pattern on a medium, wherein said correction pattern:

is constituted by a line group including a plurality of lines arranged in an intersecting direction that intersects a movement direction of nozzles, each of said lines being made of a plurality of dots arranged in said movement direction, and is printed by alternately repeating an operation of ejecting ink from a plurality of said nozzles and an operation of moving said medium in said intersecting direction;

(b) a step of setting for each of said lines a correction value for correcting a darkness in said intersecting direction of an image to be printed on said medium, wherein each of said correction values is set based on a darkness of N lines that are adjacent to one another in said intersecting direction, in said line group, including the line whose correction value is to be set, and wherein said N lines are two to four lines; and (c) a step of printing said image on said medium based on said correction values that have been set for each of said lines.

5. A printing method according to claim 3, wherein the correction value of a given line is set based on the darkness of each of said N lines.

6. A printing method comprising:

(a) a step of printing a correction pattern on a medium, wherein said correction pattern:

is constituted by a line group including a plurality of lines arranged in an intersecting direction that intersects a movement direction of nozzles, each of said lines being made of a plurality of dots arranged in said movement direction, and is printed by alternately repeating an operation of ejecting ink from a plurality of said nozzles and an operation of moving said medium in said intersecting direction;

(b) a step of setting for each of said lines a correction value for correcting a darkness in said intersecting direction of an image to be printed on said medium, wherein each of said correction values is set based on a darkness of N lines that are adjacent to one another in said intersecting direction, in said line group, including the line whose correction value is to be set, wherein said correction value is set to a value that is shared by said N lines, and wherein said shared value is an average value of provisional correction values, each of said provisional correction values being obtained based on the darkness of the respective one of said N lines; and (c) a step of printing said image on said medium based on said correction values that have been set for each of said lines.

7. A panting method comprising:

(a) a step of printing a correction pattern on a medium, wherein said correction pattern:

is constituted by a line group including a plurality of lines arranged in an intersecting direction that intersects a movement direction of nozzles, each of said lines being made of a plurality of dots arranged in said movement direction, and is printed by alternately repeating an operation of ejecting ink from a plurality of said nozzles and an operation of moving said medium in said intersecting direction;

(b) a step of setting for each of said lines a correction value for correcting a darkness in said intersecting direction of an image to be printed on said medium, wherein each of said correction values is set based on a darkness of N lines that are adjacent to one another in said intersecting direction, in said line group, including the line whose correction value is to be set, wherein the correction value of a given line is set based on the darkness of each of said N lines, and wherein said correction value of the given line is an average value of provisional correction values, each of said provisional correction values being obtained based on the darkness of the respective one of said N lines; and (c) a step of printing said image on said medium based on said correction values that have been set for each of said lines.

8. A printing method according to claim 7, wherein said average value of said provisional correction values is an average value of a provisional correction value corresponding to said given line and provisional correction values corresponding to lines that are adjacent to said given line on both sides thereof in said intersecting direction and that sandwich said given line.

9. A printing method according to claim 7, wherein said average value of said provisional correction values is an average value of a provisional correction value corresponding to said given line and a provisional correction value corresponding to a line that is adjacent to said given line on one side thereof in said intersecting direction.

10. A printing method comprising:

(a) a step of printing a correction pattern on a medium, wherein said correction pattern:

is constituted by a line group including a plurality of lines arranged in an intersecting direction that intersects a movement direction of nozzles, each of said lines being made of a plurality of dots arranged in said movement direction, and is printed by alternately repeating an operation of ejecting ink from a plurality of said nozzles and an operation of moving said medium in said intersecting direction;

(b) a step of setting for each of said lines a correction value for correcting a darkness in said intersecting direction of an image to be printed on said medium, wherein each of said correction values:

is set as an average value of provisional correction values, each of said provisional correction values being obtained based on the darkness of a respective one of two to four lines, in said line group, that are adjacent to one another in said intersecting direction and that include the line whose correction value is to be set, and is set to a value that is shared by said two to four lines, or, the correction value of a given line is set as:

an average value of a provisional correction value obtained based on the darkness of said given line, in said line group, and provisional correction values each obtained based on the darkness of a respective one of two to four lines that are adjacent to said given line on both sides thereof in said intersecting direction and that sandwich said given line, or, an average value of a provisional correction value obtained based on the darkness of said given line, in said line group, and provisional correction values each obtained based on the darkness of a respective one of two to four lines that are adjacent on one side of said given line in said intersecting direction; and (c) a step of printing said image on said medium by changing gradation values of said image based on said correction values that have been set for each of said lines, and forming said lines at a darkness corresponding to the gradation values, setting a line that is not formed between the lines that are formed by carrying out the operation of ejecting ink from said plurality of said nozzles once, and forming lines in a complementary manner by carrying out the operation of ejecting ink from said plurality of said nozzles a plurality of times.

11. A printing apparatus comprising:

nozzles for ejecting ink;

a carry unit for carrying a medium in an intersecting direction that intersects a movement direction; and a controller for controlling ejection of ink from said nozzles and carrying of the medium by said carry unit, said controller configured to control the printing apparatus to:

(A) print a correction pattern on the medium using said nozzles and said carry unit, wherein said correction pattern:

is constituted by a line group including a plurality of lines arranged in the intersecting direction that intersects the movement direction, each of said lines being made of a plurality of dots arranged in the movement direction of the nozzles, and is printed by alternately repeating an operation of ejecting ink from a plurality of said nozzles and an operation of moving said medium in said intersecting direction;

(B) set for each of said lines a correction value for correcting a darkness in said intersecting direction of an image to be printed on said medium, wherein each of said correction values is set based on a darkness of N lines that are adjacent to one another in said intersecting direction, in said line group, including the line whose correction value is to be set, and wherein said correction value is set to a value that is shared by said N lines; and (C) print, using said nozzles and said carry unit, said image on said medium based on said correction values that have been set for each of said lines.

* * * * *